US005597119A

United States Patent [19]

Gorney et al.

[11] Patent Number: 5,597,119

[45] Date of Patent: Jan. 28, 1997

[54] ROTATING SPINKLER HAVING MAGNETIC COUPLING ELEMENTS FOR TRANSMITTING MOTION

[75] Inventors: Moshe Gorney; Izhak Gal, both of Kibbutz Naan, Israel

[73] Assignee: Naan Irrigation Systems, Kibbutz Naan, Israel

[21] Appl. No.: 268,238

[22] Filed: Jun. 29, 1994

[30] Foreign Application Priority Data

Jun. 30, 1993 [IL] Israel ..... 106200

[51] Int. Cl.[6] ..... B05B 3/04

[52] U.S. Cl. ..... 239/241; 239/DIG. 1; 239/DIG. 11

[58] Field of Search ..... 239/237, 240, 239/241, 242, DIG. 1, DIG. 11; 310/75 D, 103

[56] References Cited

U.S. PATENT DOCUMENTS

| | | | |
|---|---|---|---|
| 2,481,360 | 9/1949 | Sprenger | 310/103 |
| 2,909,327 | 10/1959 | Li . | |
| 3,169,398 | 2/1965 | Sparling et al. | 310/103 |
| 3,523,204 | 8/1970 | Rand | 310/103 |
| 3,621,424 | 11/1971 | Query | 310/103 |
| 3,915,383 | 10/1975 | King | 239/242 |
| 3,921,912 | 11/1975 | Hayes | 239/242 |
| 4,320,927 | 3/1982 | Sertich . | |
| 4,353,506 | 10/1982 | Hayes | 239/231 |
| 4,540,125 | 9/1985 | Gorney et al. . | |
| 4,850,821 | 7/1989 | Sakai . | |
| 4,909,327 | 3/1990 | Roche . | |
| 4,913,346 | 4/1990 | Nakamura et al. | 239/240 |

FOREIGN PATENT DOCUMENTS

| | | | |
|---|---|---|---|
| 1-34172 | 2/1989 | Japan | 310/103 |
| 2-214468 | 8/1990 | Japan | 310/103 |
| 2221333 | 1/1990 | United Kingdom | 310/103 |

*Primary Examiner*—Karen B. Merritt
*Attorney, Agent, or Firm*—Wolf, Greenfield & Sacks, P.C.

[57] ABSTRACT

A sprinkler including a liquid inlet, a liquid outlet rotatable with respect to the liquid inlet and apparatus, driven by a pressurized flow of liquid entering the liquid inlet, for rotating the liquid outlet, the apparatus including magnetic coupling apparatus for transmitting motion.

22 Claims, 19 Drawing Sheets

ROTATING SPINKLER HAVING MAGNETIC COUPLING ELEMENTS FOR TRANSMITTING MOTION

FIELD OF THE INVENTION

The present invention relates to irrigation apparatus generally and more particularly to sprinklers.

BACKGROUND OF THE INVENTION

A great variety of sprinklers are known in the art. Generally sprinklers include a large number of interconnected mechanical parts, at least some of which are in contact with water during operation. As a result, the impurities in the water tend to collect and eventually interfere with the proper operation of the sprinkler.

Various sprinkler designs have been proposed in which at least some of the mechanical parts are isolated from the water. Sprinklers designed in this manner are generally relatively complicated and expensive to manufacture.

U.S. Pat. No. 2,909,327 issued to Li discloses a lawn sprinkler that has a rotatable nozzle. A turbine causes wheels to move in guide slots, which allows the nozzle to be shifted and produce a spray pattern. In one embodiment, the wheels are magnetic so as to ensure their engagement with the sides of the slots.

U.S. Pat. No. 4,920,465 issue to Sargent discloses a fountain which has a lamp for illuminating the fountain. The fountain receives water which is under pressure and uses it to drive a turbine. The turbine is magnetically coupled to drive a generator which is located in a watertight envelope. The electricity generated by the generator is used to light the lamp.

U.S. Pat. No. 4,850,821 issued to Sakai discloses a multiple pump system driven by an electric motor with an intermediate magnetic coupling.

U.S. Pat. No. 4,320,927 issued to Sertich discloses a dental drill in which an air driven turbine is used to drive a dental drill. Magnets are used to stabilize the shaft of the drill against axial and transverse-plane movement.

SUMMARY OF THE INVENTION

The present invention seeks to provide an improved sprinkler which obviates many of the problems presently encountered in existing sprinklers.

There is thus provided in accordance with a preferred embodiment of the invention, a sprinkler including a liquid inlet, a liquid outlet rotatable with respect to the liquid inlet and apparatus, driven by a pressurized flow of liquid entering the liquid inlet, for rotating the liquid outlet, the apparatus including magnetic coupling apparatus for transmitting motion.

Preferably the magnetic coupling apparatus includes at least one driving magnet and at least one driven magnet and rotation of the at least one driving magnet produces intermittent rotation of the at least one driven magnet.

In accordance with a preferred embodiment of the invention, the driving magnet is mounted on a turbine driven for rotation by the pressurized flow of liquid.

Preferably, the driving magnet and the driven magnet are restricted to rotation in parallel mutually spaced planes and wherein spacing between the planes of rotation of the driving magnet and the driven magnet is decreased to a spacing at which a repelling magnetic force interaction between the driving magnet and the driven magnet can take place in response to at least a predetermined rate of flow of the liquid.

Also in accordance with a preferred embodiment of the present invention, the driving magnet is mounted for rotation by the pressurized flow of liquid.

Preferably, the driving magnet is tethered to a fixed location and wherein spacing between the driving magnet and the driven magnet is decreased to a spacing at which a repelling magnetic force interaction between the driving magnet and the driven magnet can take place in response to at least a predetermined rate of flow of the liquid.

In accordance with a preferred embodiment of the present invention, the driving magnet is mounted for rotation in a plane at a radial location determined at least in part by the pressurized flow of liquid.

Preferably, the driving magnet is tethered to a fixed location and wherein radial spacing between the driving magnet and the driven magnet is decreased to a spacing at which a repelling magnetic force interaction between the driving magnet and the driven magnet can take place in response to at least a predetermined rate of flow of the liquid.

Alternatively, the driving magnet is radially slidably mounted in a plane whereby the radial orientation of its magnetic poles is maintained and wherein radial spacing between the driving magnet and the driven magnet is decreased to a spacing at which a repelling magnetic force interaction between the driving magnet and the driven magnet can take place in response to at least a predetermined rate of flow of the liquid.

In accordance with an alternative embodiment of the present invention, the magnetic coupling apparatus includes at least one driving magnet and at least one driven magnet and rotation of the at least one driving magnet produces corresponding rotation of the at least one driven magnet.

In accordance with one embodiment of the present invention, the magnetic coupling apparatus includes at least one rotating driving magnet and the liquid driven transmission is not engaged until the rotating driving magnet is rotating at a predetermined minimum rate of rotation.

Preferably the magnetic coupling apparatus includes a coupled pair of magnetic coupling elements.

In accordance with a preferred embodiment of the present invention, the magnetic coupling apparatus includes first and second pairs of magnetic coupling elements and the sprinkler further includes a gear train located in a watertight sealed section of the sprinkler and including a plurality of gears, including a first gear, mechanically driven by the first pair of magnetic coupling elements and a last gear, mechanically driving the liquid outlet via the second pair of magnetic coupling elements.

Also in accordance with a preferred embodiment of the present invention, the magnetic coupling apparatus includes at least one pair of magnetic coupling elements and the sprinkler further includes a gear train located in a watertight sealed section of the sprinkler and including a plurality of gears, including a first gear and a last gear, at least one of which is drivingly coupled to another part of the sprinkler by a pair of magnetic coupling elements.

In accordance with a preferred embodiment of the present invention, the magnetic coupling apparatus includes at least one driving magnet and at least one driven magnet driven by the driver magnet but not in physical contact therewith. The driving magnet and the driven magnet may be arranged to exert an attractive force on each other. Preferably, the driving magnet and the driven magnet are arranged to exert a repelling force on each other.

In accordance with a preferred embodiment of the present invention, rotation of the driving magnet exerts a force on the driven magnet only during a portion of the rotation thereof.

Additionally in accordance with a preferred embodiment of the present invention, the magnetic coupling apparatus includes a rotating driving magnet and a rotatable driven magnet coupled to the liquid outlet, whereby the driving magnet and the driven magnet are close enough to interact only as the driving magnet rotates past the driven magnet, wherein the inertia of the driven magnet and the liquid outlet are such that as the rotating driving magnet rotates past the driven magnet in propinquity thereto, the force exerted by the rotating magnet on the driven magnet is sufficient to move the driven magnet a short distance.

Additionally in accordance with a preferred embodiment of the present invention there is provided a sprinkler comprising azimuthal sprinkling zone defining apparatus including magnets.

Preferably, the azimuthal sprinkling zone defining apparatus comprises at least first and second magnets interacting in a repulsion mode.

In accordance with a preferred embodiment of the present invention, the magnets define an over-center mechanism.

In accordance with a preferred embodiment of the present invention, the sprinkler is a gear sprinkler and the magnets define an over-center mechanism which changes the direction of rotation of the liquid outlet by varying the engagement arrangement of gears.

Alternatively, the sprinkler may be an impact sprinkler and the magnets define an over-center mechanism which changes the direction of rotation of the liquid outlet by changing the mode of operation of an impact assembly forming part thereof.

The magnets may form part of a water flow direction change mechanism.

BRIEF DESCRIPTION OF THE DRAWINGS

The present invention will be understood and appreciated more fully from the following detailed description, taken in conjunction with the drawings in which:

FIGS. 12A and 12B are sectional illustrations of a sprinkler constructed and operative in accordance with a still further alternative embodiment of the present invention in respective at-rest and operative orientations;

DETAILED DESCRIPTION OF THE PREFERRED EMBODIMENTS

Figure 1A:
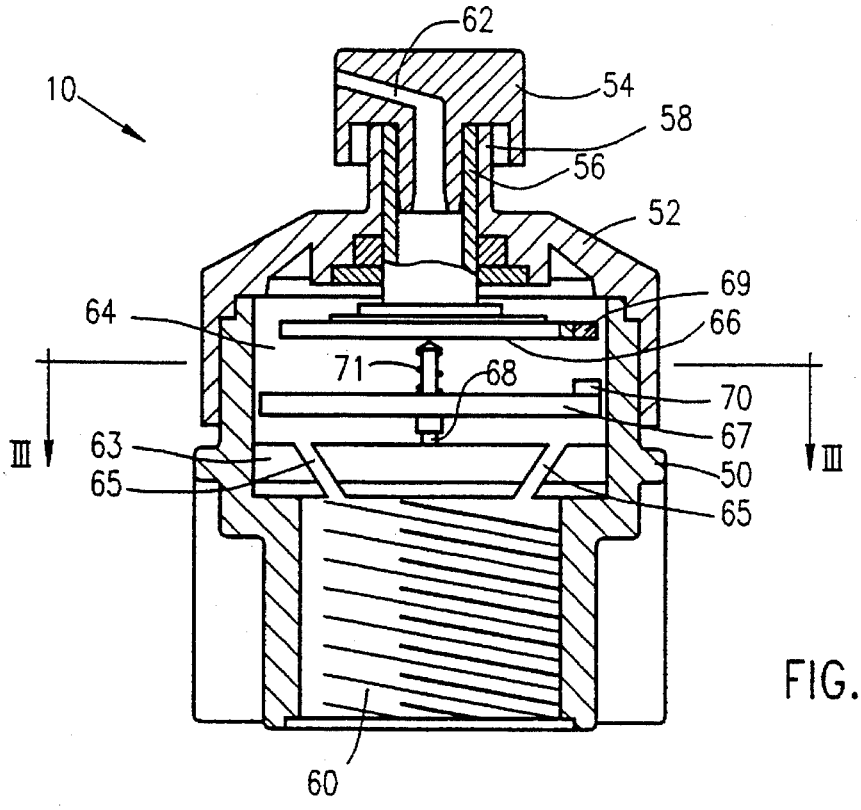
FIGS. 1A and 1B are sectional illustrations of a sprinkler constructed and operative in accordance with a preferred embodiment of the present invention in respective at rest and operative orientations.
Figure 1B:
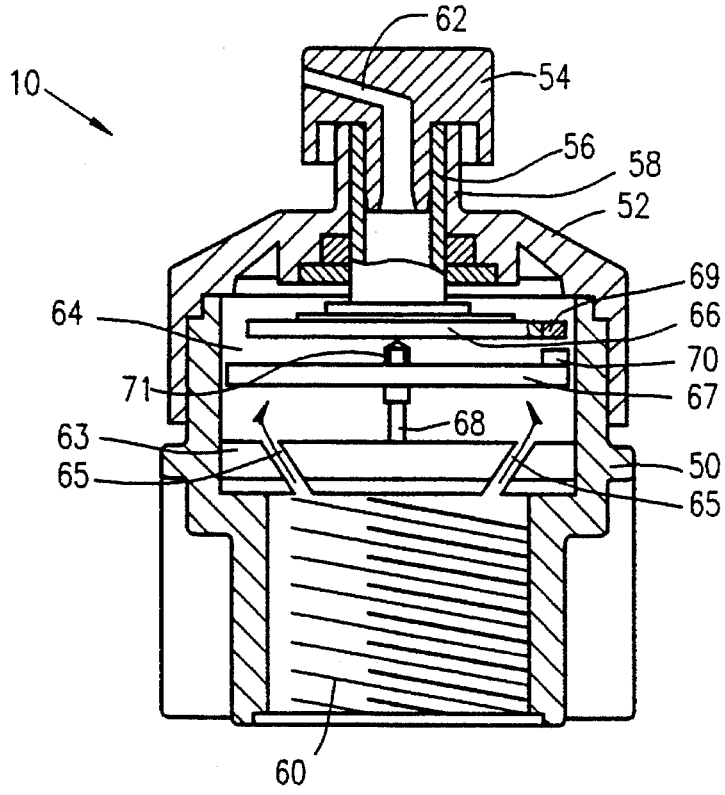

FIGS. 1A and 1B show a preferred embodiment of the present invention. As shown in FIG. 1A, a sprinkler 10 comprises a casing 50, a cap 52 which is mounted onto casing 50 as by threading, and a rotatable top 54, which is rotatably mounted onto cap 52. Rotatable top 54 is fixedly mounted onto a neck member 56 for rotation together therewith inside a collar portion 58 of cap 52.

A liquid inlet 60 is formed at an end of casing 50 opposite cap 52, and is threaded to facilitate connection of the sprinkler to a water supply. A liquid outlet 62 is formed in top 54, and provides a water passage communicating with the interior of casing 50. A dividing wall 63 separates liquid inlet 60 from an interior chamber 64. One or more holes 65, formed through dividing wall 63, allow water to pass from liquid inlet 60 through chamber 64 to liquid outlet 62.

Figure 2:
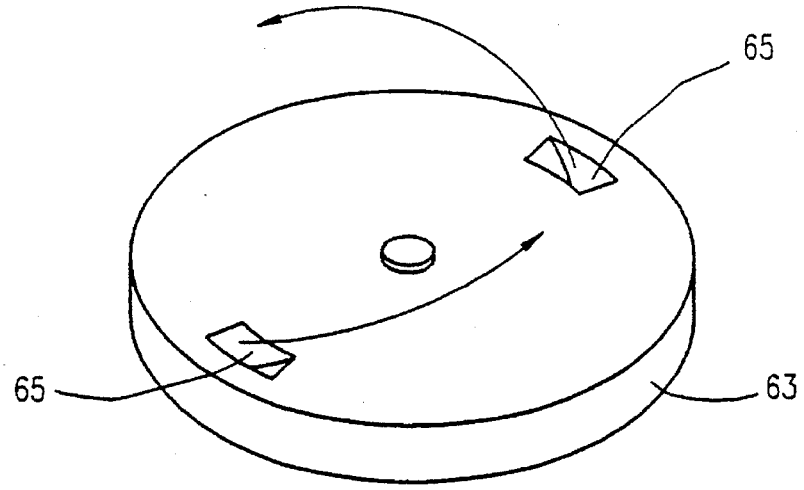
FIG. 2 is an illustration of part of the sprinkler of FIGS. 1A and 1B, and illustrates how a rotational component is given to the motion of the water entering the sprinkler.

As shown in FIG. 2, holes 65 are angled so as to impart a rotational component to the motion of water entering chamber 64 from inlet 60. A rotatable disk 66, located in chamber 64, is fixedly attached to neck member 56 or integrally formed therewith, so that disk 66 and top 54 rotate together.

A turbine 67 is located in chamber 64, and is rotatably mounted on a shaft 68. A permanent magnet 69 is mounted on the edge of disk 66 with one of its poles facing downwards towards turbine 67. A second permanent magnet 70 is mounted on top of turbine 67 with the same pole facing up towards disk 66 and permanent magnet 69, so that magnets 69 and 70 are arranged to exert a repelling force on each other. A spring 71, when uncompressed, maintains a sufficient distance between disk 66 and turbine 67 so that magnets 69 and 70 do not substantially interact when turbine 67 is not raised by the action of water towards disk 66.

During operation of sprinkler 10, water from a water supply (not shown) traverses inlet 60 and enters chamber 64 via holes 65. Because of the orientation of holes 65 the water entering chamber 64 may swirl upward in the shape of a helix. The rotational component of this flow causes turbine 67 to rotate, and the upward component of this flow causes turbine 67 to compress spring 71 and move closer to disk 66, as shown in FIG. 1B. As disk 66 rotates, magnets 69 and 70 interact, as will now be explained in conjunction with FIG. 3A–3C. Alternatively, raising of the turbine 67 and compression of spring 71 may be caused wholly or partially by other actions of the water, such as the static water pressure or the provision of suitably oriented fins on turbine 67 which provide both rotation and lift. In certain cases, the provision of spring 71 may be obviated.

Figure 3A:
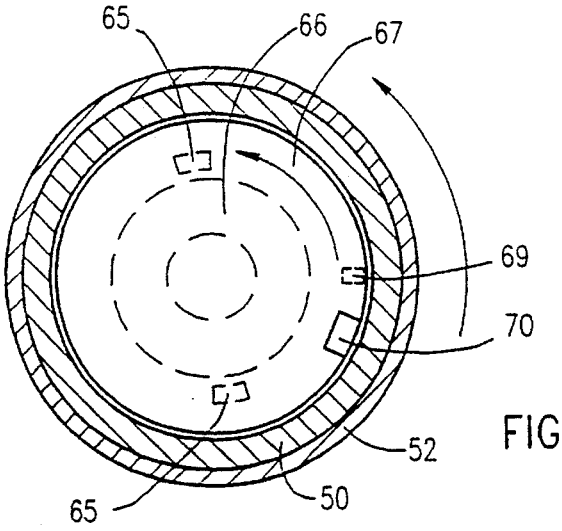
FIGS. 3A, 3B and 3C are sectional illustrations taken generally in the plane III—III of FIGS. 1A and 1B, which schematically illustrate the magnetic drive operation of the sprinkler of FIGS. 1A and 1B.
Figure 3B:
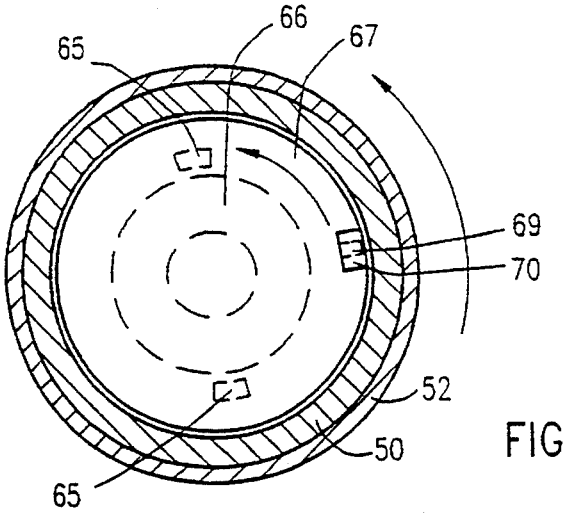
Figure 3C:
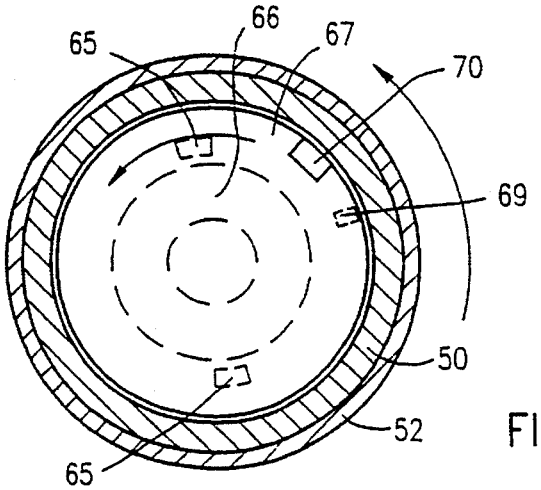

FIGS. 3A–3C schematically show the portion of the rotation of turbine 67 during which magnet 70 is close enough to exert a force on magnet 69, mounted on disk 66. It is to be noted that in FIGS. 3A–3C, the disk 66 and the magnet 69 are not seen in the section taken along lines III—III in FIG. 1A. For the sake of clarity in explanation, these elements are indicated in FIGS. 3A–3C in phantom lines.

As magnet 70 nears magnet 69 (FIG. 3A), it exerts a force on magnet 69 tending to rotate disk 66 and top 54. The inertia of top 54 and disk 66 and the brief duration of the force exerted on magnet 69 by revolving magnet 70, ensure that magnet 70 is only able to push magnet 69 a short distance before magnet 70 revolves out of range, as is shown in FIG. 3C. The small movement of magnet 69 causes liquid outlet 62 to rotate a small amount in azimuth, which changes the direction of the water from sprinkler 10. Since top 54 rotates only slightly with each complete rotation of turbine 67, the combination of elements shown in FIG. 1A act as a gear down transmission to rotate top 54 at a slower rate than turbine 67.

The purpose of spring 71 is to ensure that magnets 69 and 70 do not interact until turbine 67 is rotating at a relatively high rate. This is an important feature of this embodiment of the invention, because if turbine 67 and disk 66 are allowed near each other before turbine 67 has gathered sufficient rotational momentum, the repelling force of magnet 69 on magnet 70 will be sufficient to stop magnet 70 from passing magnet 69. In such a case, turbine 67 may stop rotating, and consequently, the sprinkler will direct water only in a single direction.

Figure 4A:
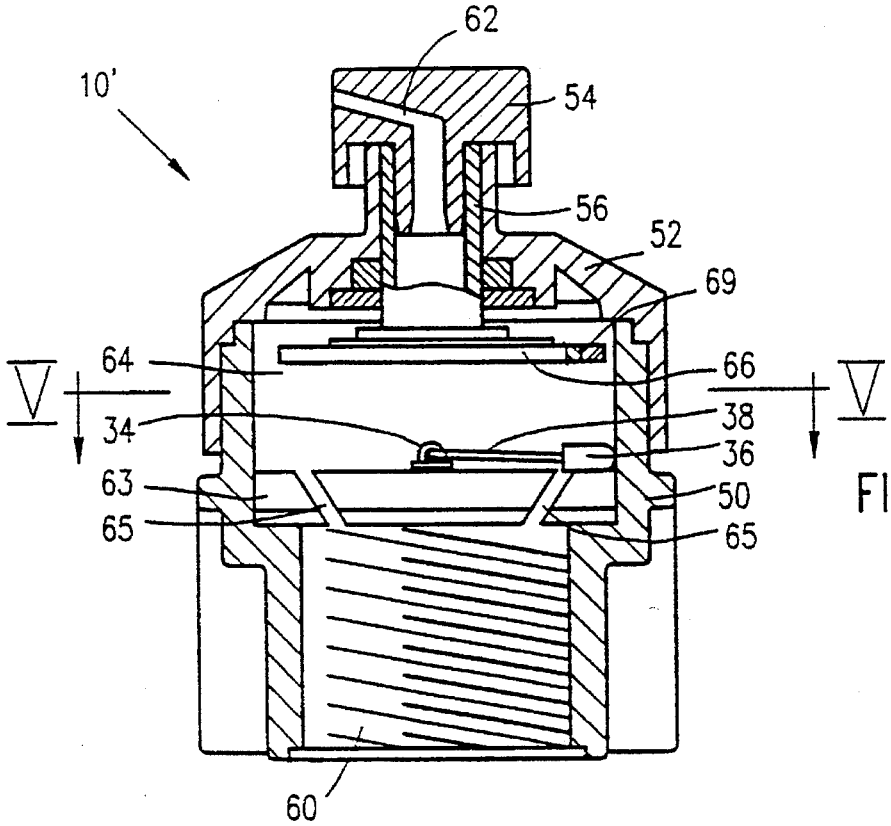
FIGS. 4A and 4B are sectional illustrations of a sprinkler constructed and operative in accordance with another preferred embodiment of the present invention in respective at-rest and operative orientations.
Figure 4B:
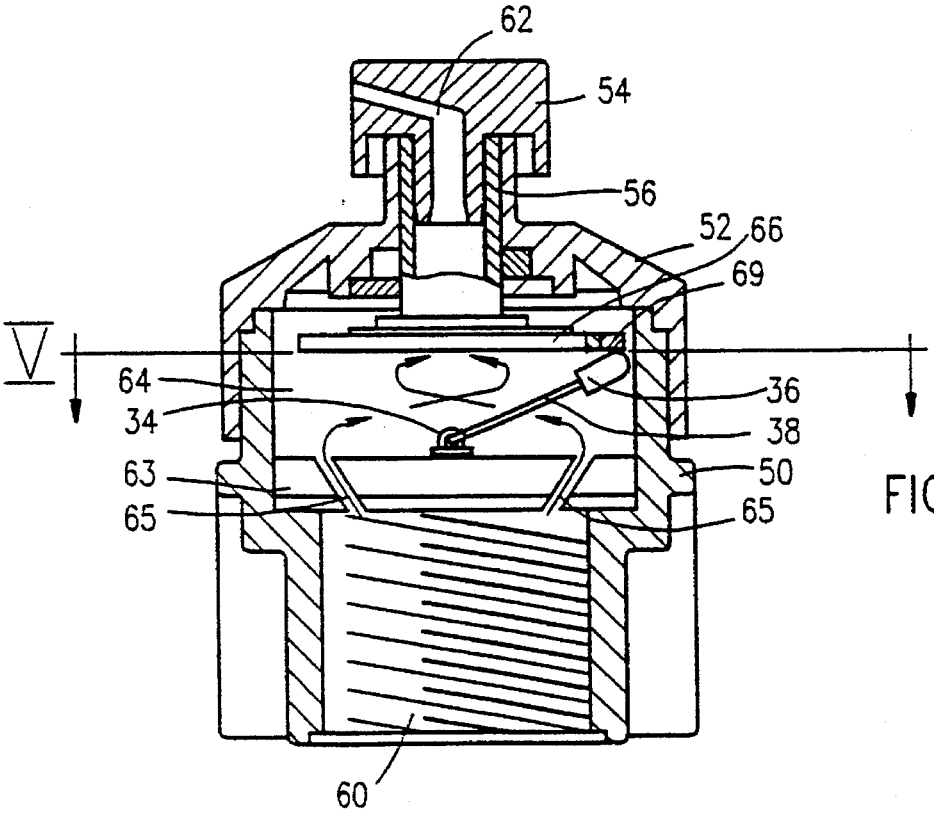

FIGS. 4A and 4B show another preferred embodiment of the present invention. Most of the parts of this embodiment are the same as the embodiment shown in FIGS. 1A and 1B, and are identified by the same reference numerals. In this embodiment, however, turbine 67 is replaced by a rotatable pivot 34 mounted on dividing wall 63. A magnet 36 is connected to pivot 34 by an elongate connector 38. Connector 38 may be rigid or flexible and is preferably hooked through pivot 34 such that connector 38 and magnet 36 can move freely closer to or further from disk 66.

Figure 5A:
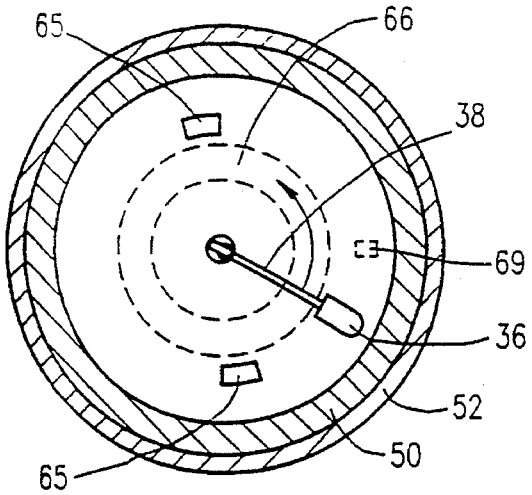
FIGS. 5A, 5B and 5C are sectional illustrations taken generally in the plane V—V of FIGS. 4A and 4B, which schematically illustrate the magnetic drive operation of the sprinkler of FIGS. 4A and 4B.
Figure 5B:
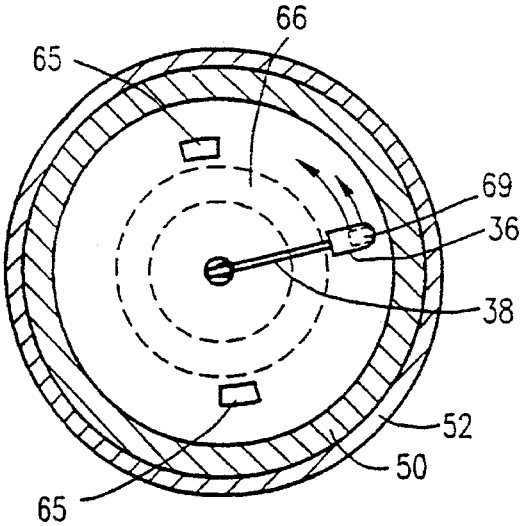
Figure 5C:
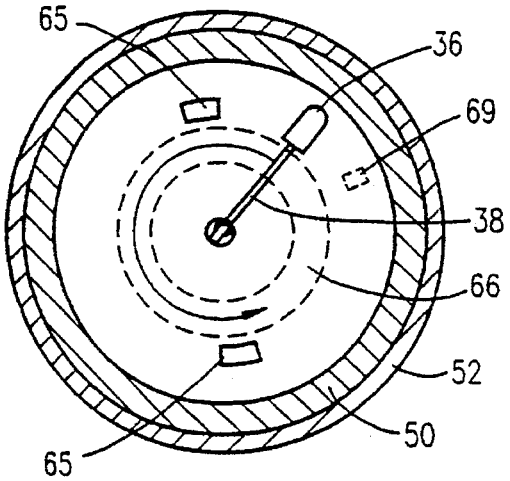

During operation, the upwardly swirling water entering chamber 64 from holes 65 causes magnet 36 to simultaneously revolve around pivot 34, and to rise to a point just below disk 66, as shown in FIG. 4B. Magnet 36 is restrained from rising higher than the height shown in FIG. 4B, so that magnet 36 is not positioned above disk 66. As magnet 36 revolves, magnets 69 and 36 interact, as shown in FIGS. 5A–5C. The interaction between magnets 36 and 69 in FIGS. 5A–5C is similar to the interaction between magnets 70 and 69 in FIGS. 3A–3C, as described above.

As in the embodiment of FIGS. 1–3, the embodiment of FIGS. 5A–5C also ensures that magnets 36 and 69 do not interact until magnet 36 is revolving at a relatively high rate. This is achieved by having magnet 36 lie on dividing wall 63 when at rest. Thus, by the time the upward component of the water flow has raised magnet 36 to its operational position near magnet 69, magnet 36 is revolving at a sufficiently high rate so that it will not be stopped by magnet 70.

Figure 6:
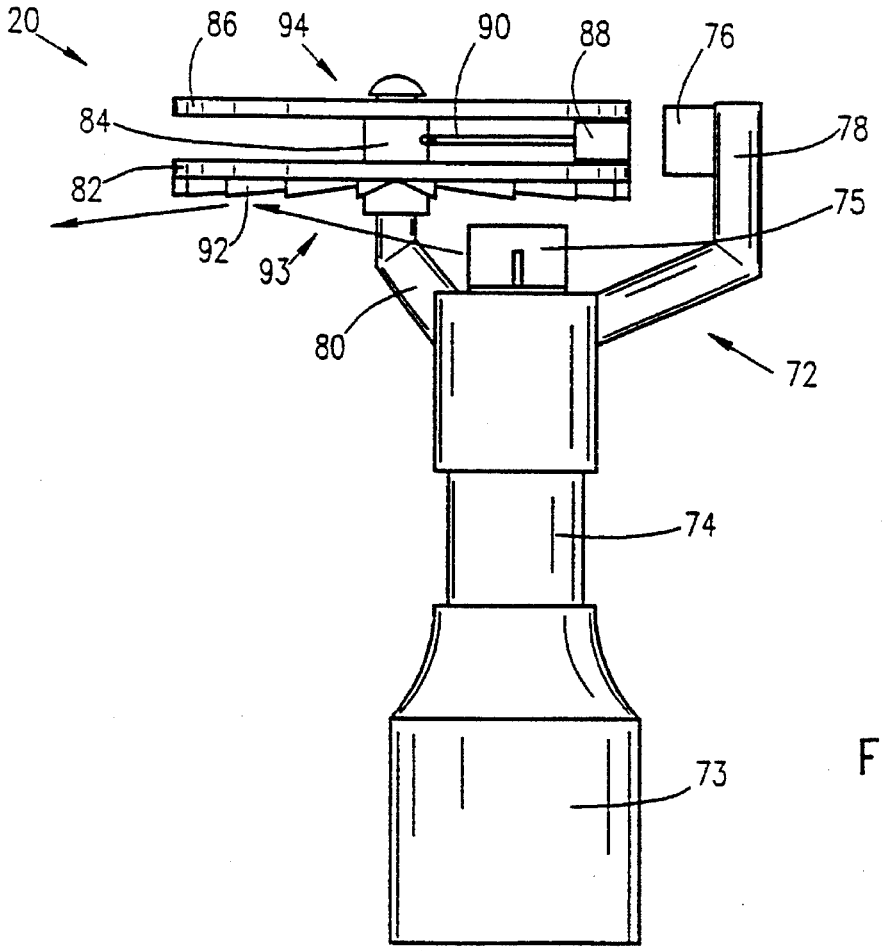
FIG. 6 is a side view of a sprinkler constructed and operative in accordance with another preferred embodiment of the present invention.

FIG. 6 shows another preferred embodiment of the present invention. As shown in FIG. 6, a sprinkler 20 comprises a a rotatable top 72. The sprinkler comprises a wide generally cylindrical lower portion 73 and a narrow generally cylindrical upper portion 74, whose inner surfaces define a liquid inlet.

Rotatable top 72 is rotatably mounted onto narrow portion 74. A nozzle 75 is fixedly attached to rotatable top 72 so that top 72 and nozzle 75 rotate together. A permanent magnet 76 is mounted on a first arm 78 which is attached to top 72, so that as top 72 rotates relative to lower portion 73, arm 78 and magnet 76 revolve about lower portion 73.

A second revolving arm 80 is also attached to top 72, and extends upward through the centers of a first rotatable disk shaped plate 82, a rotatable ring 84, and a second rotatable disk shaped plate 86. A permanent magnet 88 is attached to ring 84 by a connector 90. Magnet 88 is sandwiched between first plate 82 and second plate 86.

Figure 7A:
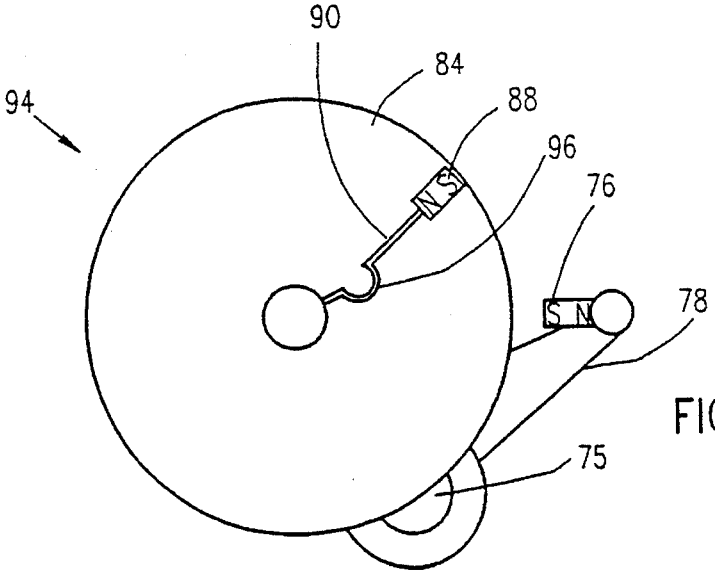
FIGS. 7A, 7B and 7C are partial top views illustrating the magnetic drive operation of the sprinkler of FIG. 6.
Figure 7B:
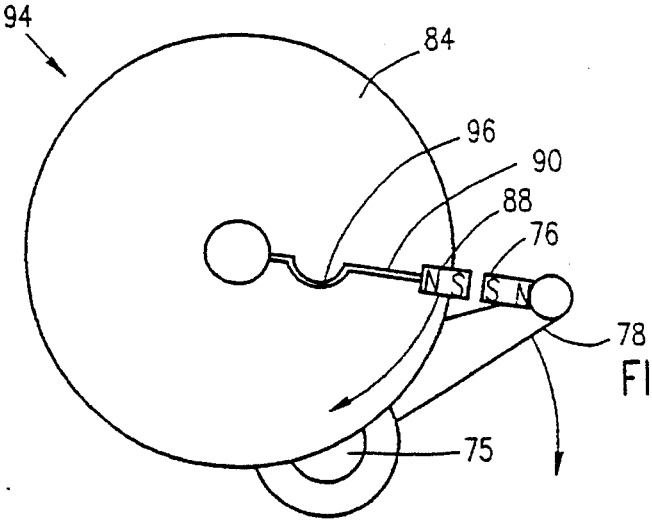
Figure 7C:
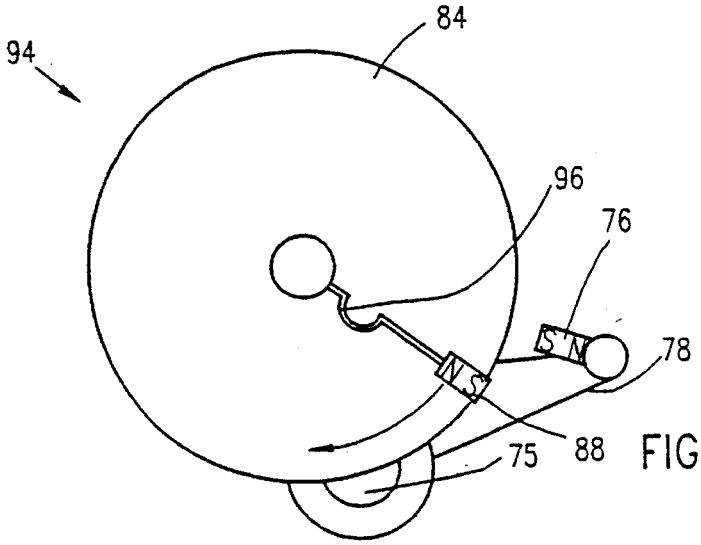

As shown in FIGS. 7A–7C, connector 90 preferably includes a resilient spring portion 96, the purpose of which will be described below. As is further shown in FIG. 7A, magnets 76 and 88 are arranged to exert a repelling force on each other. A plurality of blades 92 which form a turbine 93 are attached to the bottom of first plate 82. Plates 82 and 86, turbine 93, and ring 84 are attached to form a single rotatable unit 94 which rotates around second arm 80. Alternatively second plate 86 need not rotate together with plate 82.

During operation, water from a water supply (not shown) enters the sprinkler and is sprayed out through nozzle 75, which aims the water so as to impinge onto blades 92. The impact of the water on blades 92 causes rotatable unit 94 to rotate around second arm 80. As rotatable unit 94 rotates, magnets 76 and 88 interact, which in turn causes rotatable top 72 to rotate, as will now be explained in conjunction with FIGS. 7B and 7C.

As shown in FIG. 7B, when rotatable unit 94 reaches a high enough rate of rotation, a centrifugal force is exerted on magnet 88 which causes portion 96 of connector 90 to become distorted, which in turn causes magnet 88 to extend radially outward. In this way, portion 96 ensures that magnets 88 and 76 do not pass close to each other until rotatable unit 94 is rotating at a high enough rate so the force exerted by magnet 76 on magnet 88 will not stop rotatable unit 94 from rotating.

When magnet 88 is in its radially extended position, each time it revolves around second arm 80, it passes close enough to exert a force on magnet 76. The inertia of top 72 and the brief duration of the force from revolving magnet 88, ensure that magnet 88 is only able to push magnet 76 a short distance before it revolves out of range, as is shown in FIG. 7C.

The movement of magnet 78 causes nozzle 75 to rotate a small amount, which changes the azimuthal direction of the water from sprinkler 20.

Figure 8A:
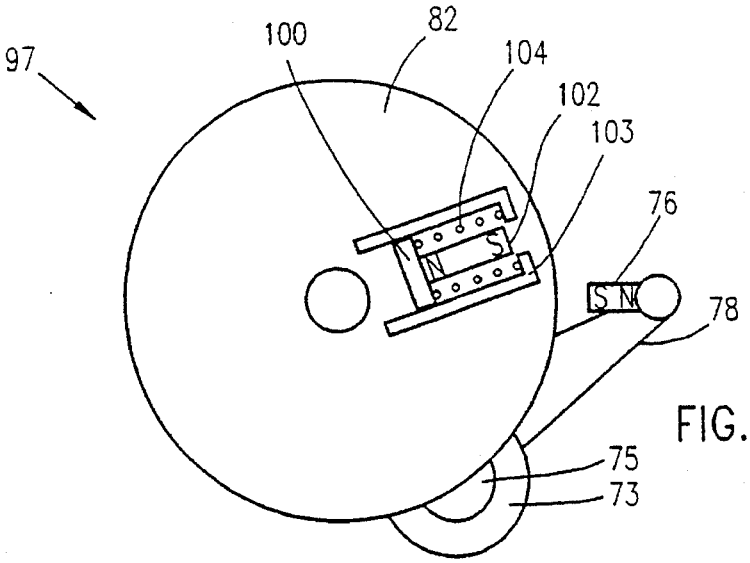
FIGS. 8A, 8B and 8C are partial top views illustrating the operation of an alternative magnetic drive for the sprinkler of FIG. 6.
Figure 8B:
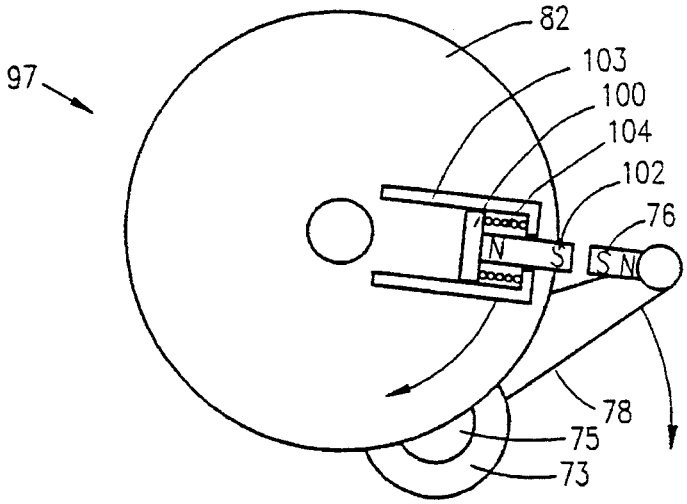
Figure 8C:
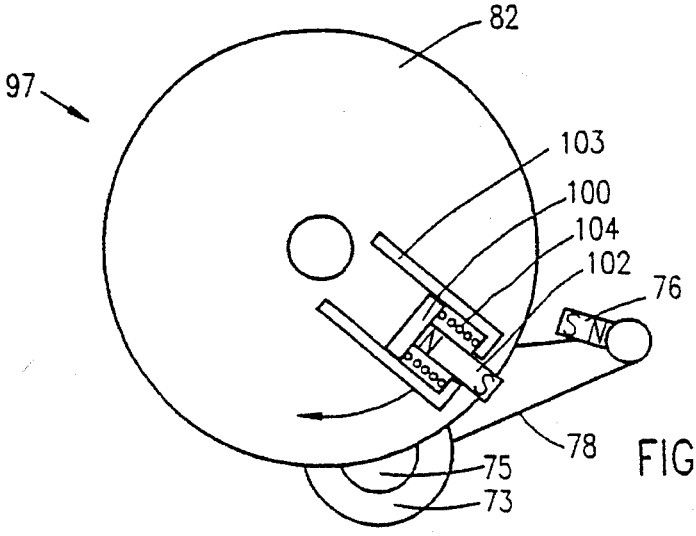

FIGS. 8A–8C show an alternate embodiment of rotatable unit 94. FIG. 8A shows a partial top view of rotatable unit 97 at rest, according to this alternate embodiment. As shown in FIG. 8A, rotatable unit 97 comprises a base 100 on which is mounted a magnet 102. Base 100 and magnet 102 are constrained to move radially by a bracket 103. A spring 104 keeps magnet 102 inside bracket 103 (and thus away from magnet 76), until rotatable unit 97 reaches a high enough rate of rotation so that the force of magnet 76 on magnet 102 will not stop rotatable unit 97 from rotating.

As shown in FIG. 8B, when rotatable unit 97 reaches a relatively high rate of rotation, the centrifugal force exerted on base 100 and magnet 102 is sufficient to cause spring 104 to become compressed, which in turn causes magnet 102 to extend radially outward. In its extended position, each time magnet 102 revolves around second arm 80, it passes close enough to exert a force on magnet 76, as described above with regard to the embodiment of FIG. 7A–7C.

It will be appreciated that the mechanism described in FIGS. 8A–8C may also be employed in the embodiments of FIGS. 12A–14 where it is desired to provide radially slidable positioning of a magnet whose radial magnetic polarity is maintained. It is appreciated that the spring 104 may be obviated in the embodiment of FIGS. 8A–8C and in any of the embodiments of FIGS. 12A–14 incorporating the mechanism of FIGS. 8A–8C.

Figure 9A:
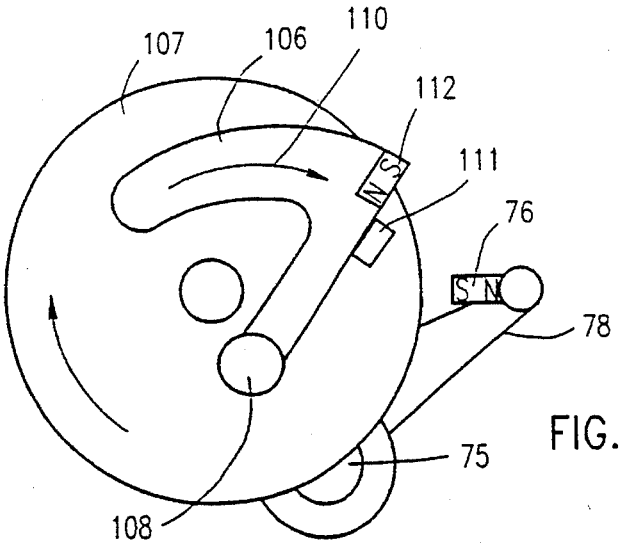
FIGS. 9A, 9B and 9C are partial top views illustrating the operation of a further alternative magnetic drive for the sprinkler of FIG. 6.
Figure 9B:
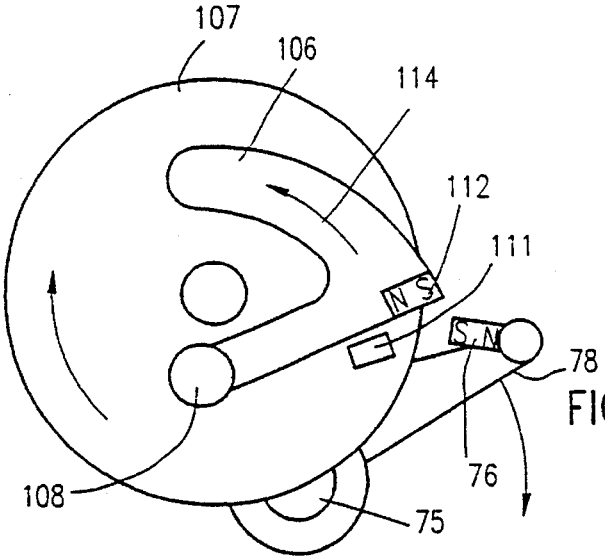
Figure 9C:
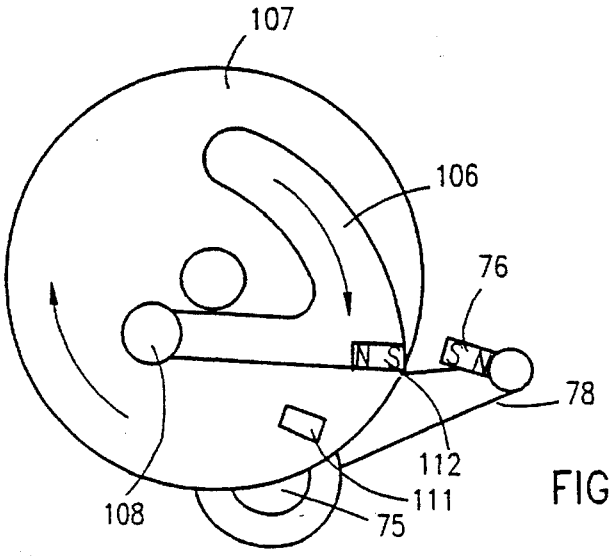

FIGS. 9A–9C show another alternate embodiment for rotatable unit 94 (FIG. 6). As shown in FIG. 9A, the rotatable unit comprises a hammer 106 which is rotatably attached to a first plate 107 by a bolt 108.

As the rotatable unit rotates, centrifugal force causes hammer 106 to rotate about bolt 108, as shown by an arrow 110, until it collides with block 111. This rotation causes a magnet 112 mounted on hammer 106 to pass relatively close to magnet 76, so that the magnets exert forces on each other.

As shown in FIG. 9B, the force exerted on magnet 112 by magnet 76 causes hammer 106 to rotate away from magnet 76 in a direction indicated by an arrow 114. The force exerted on magnet 76 causes magnet 76 to move a short distance which causes the direction of water from the sprinkler to change, as described above in connection with the embodiment of FIGS. 7A–7C.

Once magnet 112 passes magnet 76, the centrifugal force due to rotation of plate 107, causes hammer 106 to return towards its original position against block 111, as is shown in FIG. 9C.

Figure 10A:
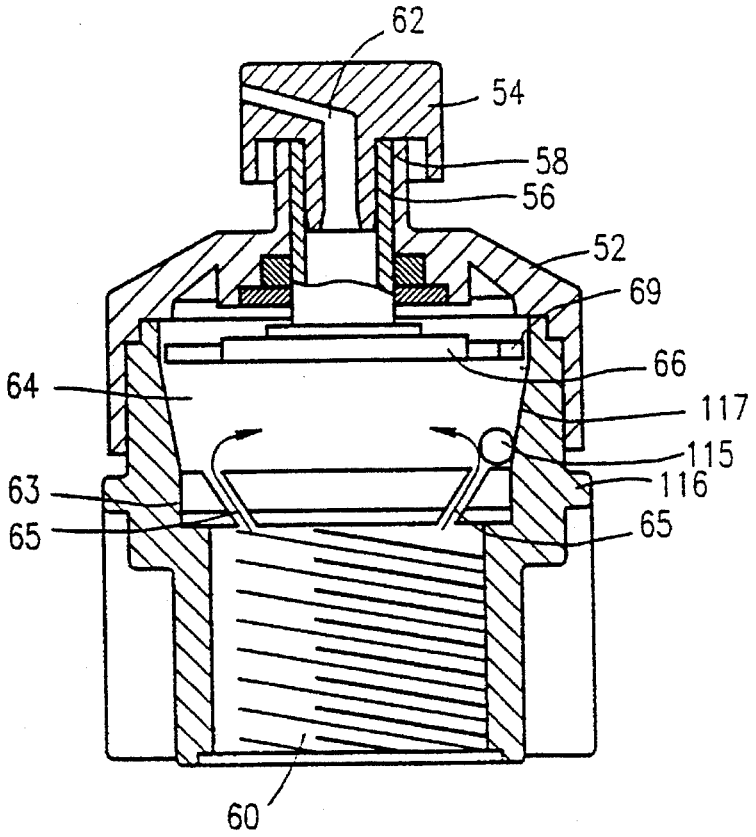
FIGS. 10A and 10B are sectional illustrations of a sprinkler constructed and operative in accordance with a further alternative embodiment of the present invention in respective at-rest and operative orientations.
Figure 10B:
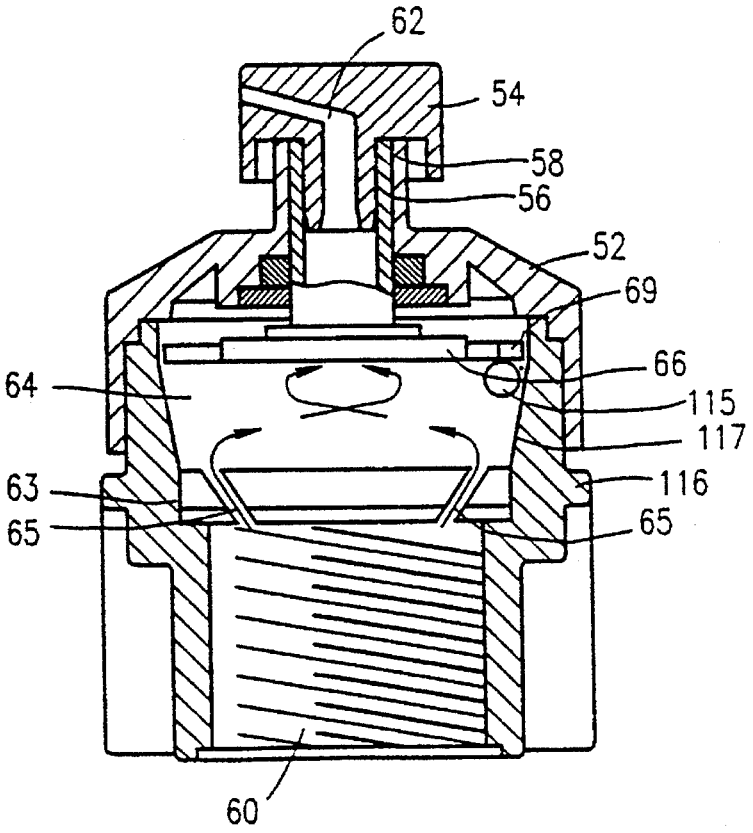

FIGS. 10A and 10B illustrate a sprinkler similar to that of FIGS. 4A and 4B except in that the magnet 36 and its mounting in the embodiment of FIGS. 4A and 4B is replaced by an unmounted magnetic ball 115. Additionally casing 50 of the embodiment of FIGS. 4A and 4B is replaced by a corresponding element 116 having a conically tapered inner surface 117.

Here magnetic ball 115 rotates under the influence of water flows in interior chamber 64. The water flows, combined with the centrifugal force produced by the rotation of the water causes ball 115 to move upward and outward along tapered inner surface 117. When the ball 115 is close to magnet 69, it causes magnet 69 to rotate much in the same way as in the embodiment of FIGS. 4A and 4B.

Preferably ball 115 is formed such that it has the same magnetic polarity generally along the entire outer surface thereof. Such a ball can be constructed, for example, of individual bipolar sections or segments which may be joined together or alternatively by magnetizing a ball during or after formation thereof in a spherically uniform magnetic field.

Figure 11A:
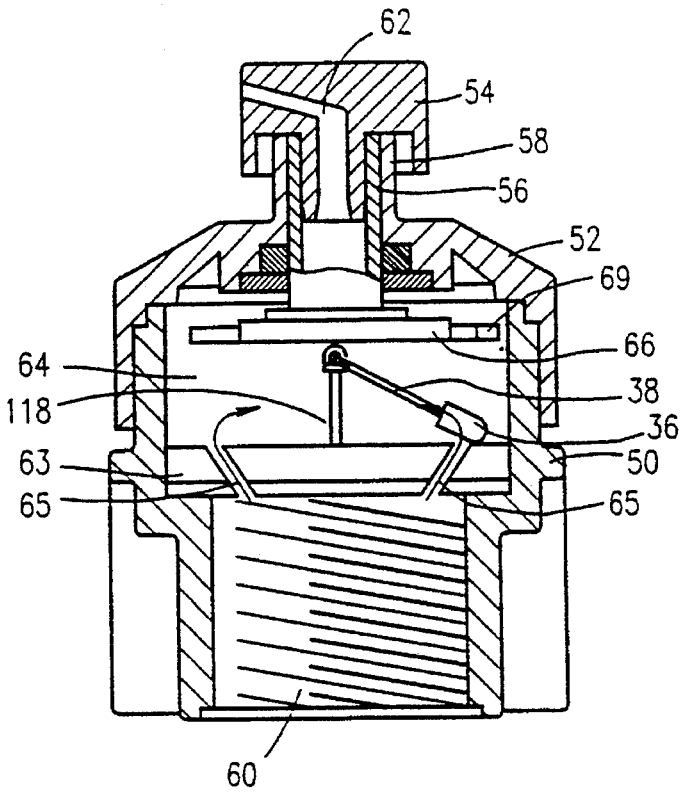
FIGS. 11A and 11b are sectional illustrations of a sprinkler constructed and operative in accordance with another alternative embodiment of the present invention in respective at-rest and operative orientations.
Figure 11B:
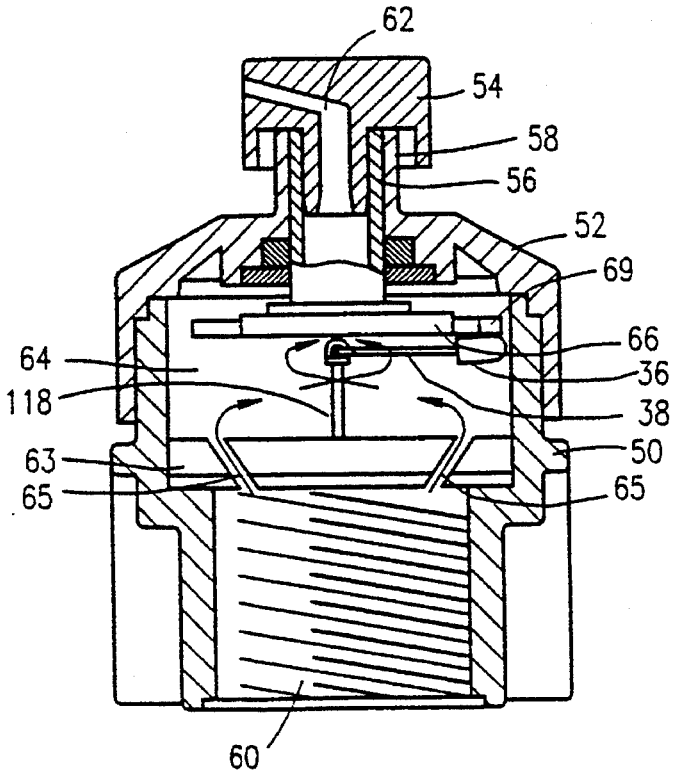

FIGS. 11A and 11B illustrate a sprinkler similar to that of FIGS. 4A and 4B except in that the rotatable pivot 34 is raised on a shaft 118. This embodiment is characterized in that the centrifugal force of rotation of magnet 36 is operative to raise the magnet 36 into magnetic force engagement with magnet 69.

Figure 12A:
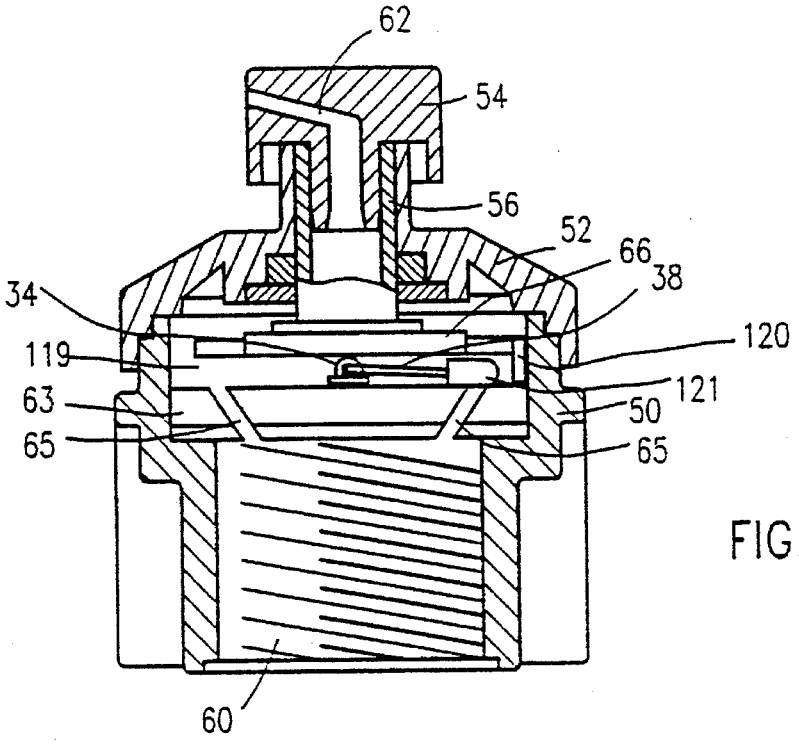
Figure 12A:
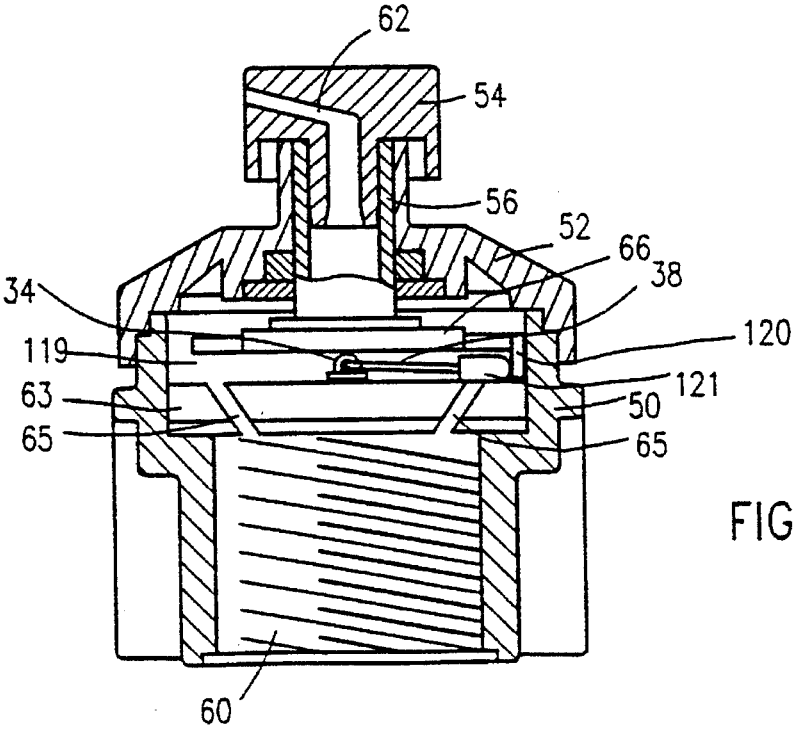

FIGS. 12A and 12B illustrate a sprinkler similar to that of FIGS. 4A and 4B except in that the interior chamber 64 in the embodiment of FIGS. 12A and 12B is made shorter than the interior chamber 64 in the embodiment of FIGS. 4A and 4B, to define a generally disk shaped chamber 119. Additionally magnet 69 of the embodiment of FIGS. 4A and 4B is rotated by 90 degrees to define a downwardly depending magnet 120, extending into chamber 119. Correspondingly, magnet 36 in the embodiment of FIGS. 4A and 4B is similar to a magnet 121 having different polarities at different radial locations therealong, such that when magnet 121 underlies magnet 120, magnetic repulsion occurs. In this embodiment, magnet 121 need not be raised by the flow of water.

In this embodiment, the elongate connector is preferably flexible or resilient so as to enable magnet 121 to vary its radial orientation and could have the configuration of element 96 in the embodiment of FIGS. 7A–7C.

Figure 13:
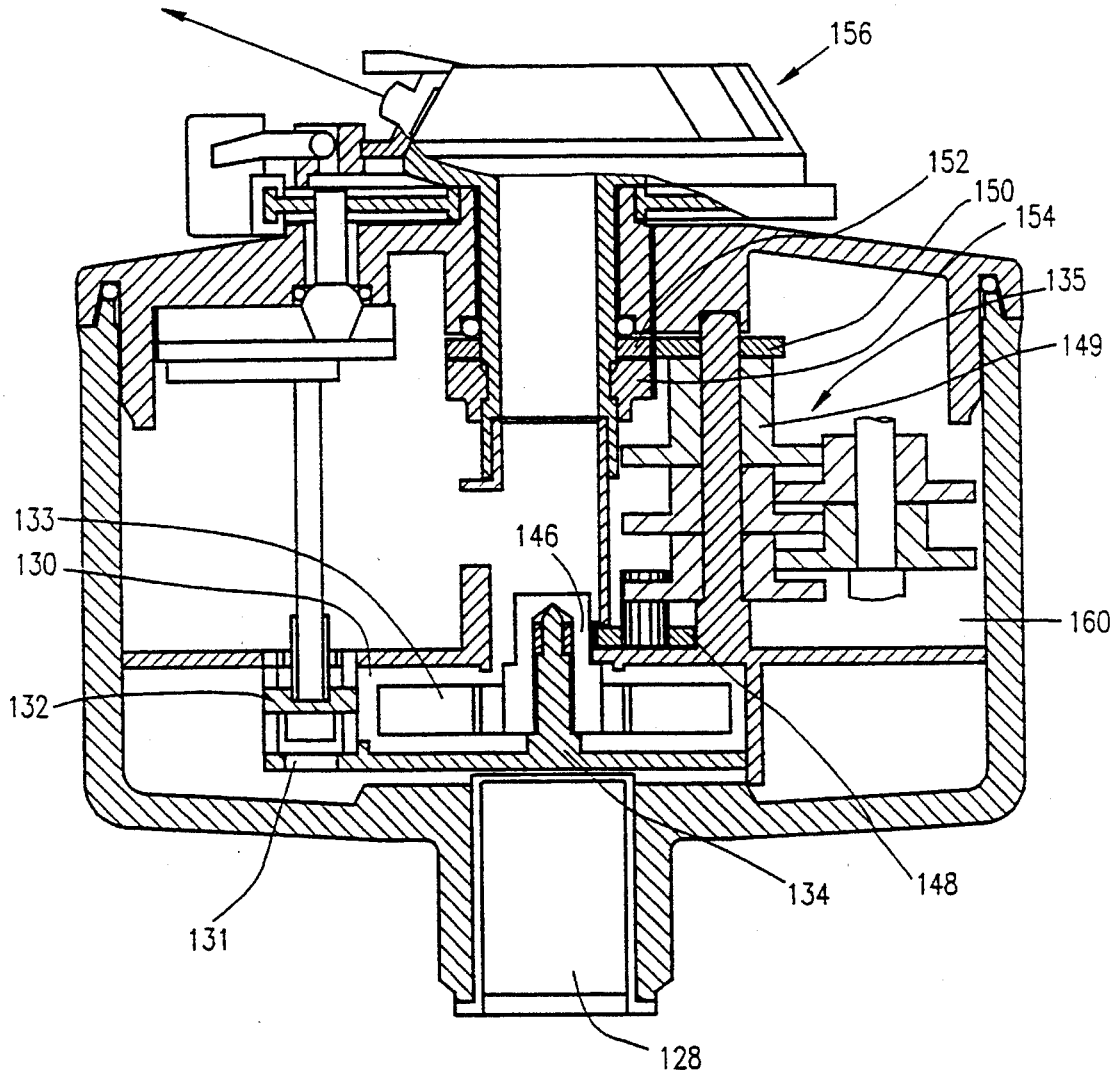
FIG. 13 is a partial sectional illustration of a sprinkler constructed and operative in accordance with another alternative embodiment of the present invention.

FIG. 13 shows another preferred embodiment of the present invention. As shown in FIG. 13, water from a liquid inlet 128 is supplied to a turbine driving chamber 130 via one or more apertures 131 and a flow director 132, for drivingly engaging a turbine 133 in a selected direction determined by flow director 132.

Turbine 133 rotates about a spindle 134 and is magnetically coupled to a reducing gear train 135 by a pair of magnetic coupling elements 146 and 148, as will be described in detail below. A gear 149 is similarly magnetically coupled by a pair of magnetic coupling elements 150 and 152 to a collar drive element 154, which frictionally engages a rotatable sprinkler head assembly 156.

In a preferred embodiment of the invention, gear train 135 is located in a watertight sealed section 160, and interacts with the rest of the sprinkler only via magnetic coupling elements 148 and 150. This represents a significant advantage over the sprinklers of the prior art in which the turbine is in physical contact with the gears, which results in damage to the gears from the water, soil, and particles passing through the sprinkler.

The above mentioned magnetic coupling between turbine 133 and collar drive element 154 via gear train 135 will now be described in conjunction with FIG. 14, which shows a simplified version of the magnetic coupling, and FIG. 15, which shows a pair of magnetic coupling elements which can represent either coupling element pair 146 and 148 or coupling element pair 150 and 152.

Figure 14:
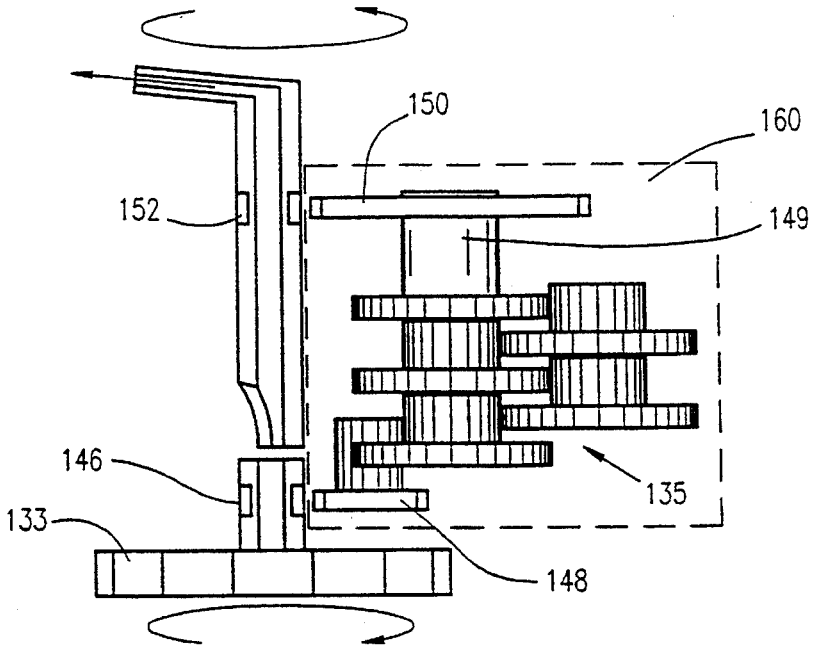
FIG. 14 is a simplified illustration of the arrangement of the permanent magnets and step-down transmission in the sprinkler of FIG. 13.
Figure 15:
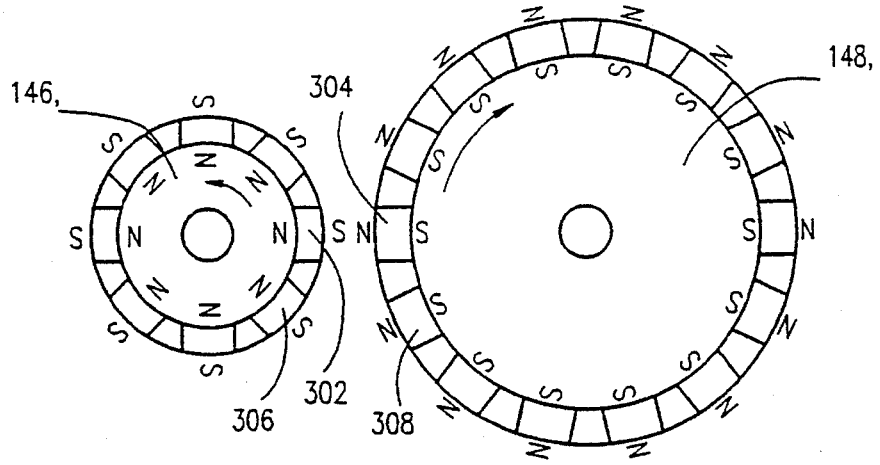
FIG. 15 is a top view illustration of a preferred embodiment of a coupling element pair in the sprinkler of FIG. 13.

As is shown in FIG. 14, rotation of turbine 133 causes magnetic coupling element 146 to rotate. As is shown in FIG. 15, each of the coupling elements 146 and 148 comprises a plurality of magnets arranged so that the magnets of one coupling element have their south poles facing outward and the magnets of the other coupling element have their north poles facing outward. The coupling elements are juxtaposed so that as coupling element 146 begins to rotate in a first direction, the attractive force exerted by a magnet 302 of rotating coupling element 146 on a magnet 304 of coupling element 148, induces coupling element 148 to rotate in the opposite direction.

As the rotation continues, magnets 302 and 304 move apart, but magnets 306 and 308 move closer together, and the attractive force between them continues the rotation of coupling element 148. Similarly, as the rotation continues, pairs of magnets continually revolve into range, exert an attractive force on each other which continues the rotation of coupling element 148, and revolve out of range. In this way, the rotation of turbine 133 is transmitted to gear train 135 via magnetic coupling elements 146 and 148.

Similarly, when gear 149 rotates in a first direction, it causes magnetic coupling element 150 to rotate in the same direction, which causes magnetic coupling element 152 to rotate in the opposite direction. In this way, the rotation of gear 149 is transmitted to collar drive element 154, via gear train 135. As described above, collar drive element 154 frictionally engages rotatable sprinkler head assembly 156, which causes rotatable sprinkler head assembly 156 to rotate, thus continuously changing the direction of the water from the sprinkler.

While a particular embodiment of the arrangement of the magnets on the magnetic coupling elements has been described, it will be appreciated by those skilled in the art, that many other arrangements of the magnets could be used to implement magnetic coupling elements 146 and 148 (and/or 150 and 152).

For example, in another possible arrangement, the polarity of every second one of the magnets of coupling elements 146 and 148 would be reversed. In such an arrangement, both the north and south poles of each magnet of coupling element 146 would respectively attract the south and north poles of a respective magnet of coupling element 148, as the magnets revolved past each other.

Figure 16:
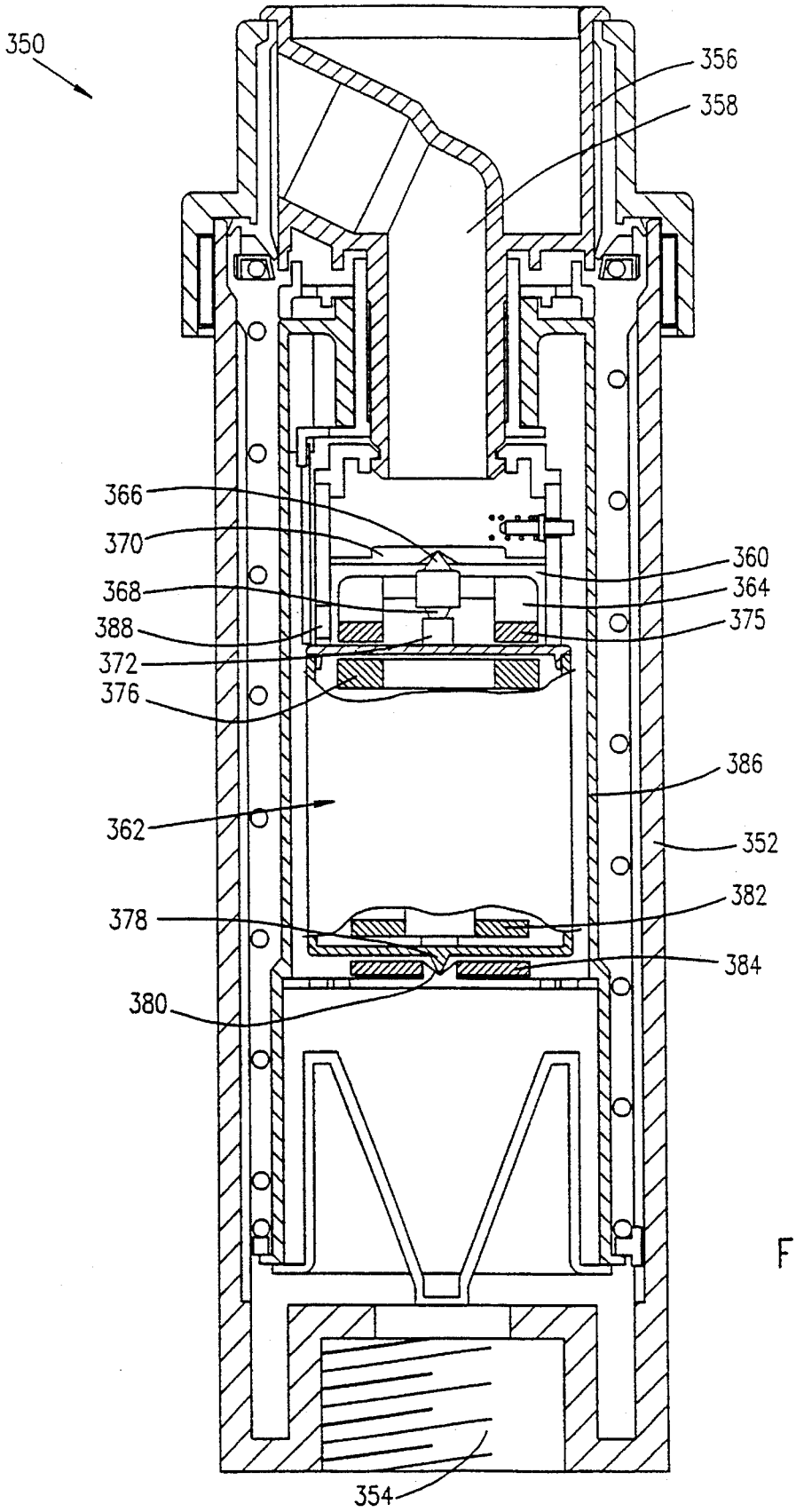
FIG. 16 is a sectional illustration of a sprinkler constructed and operative in accordance with another alternative embodiment of the present invention.

Reference is now made to FIG. 16 which shows another preferred embodiment of the present invention. As shown in FIG. 16, a sprinkler 350 comprises a generally cylindrical casing 352 which defines a liquid inlet 354, and a rotatable top 356 which is mounted in casing 352, and which defines a rotatable liquid outlet 358. A turbine driving chamber 360 and a sealed enclosure 362 are also located within the volume defined by casing 352, and are attached to top 356 so as to form a single rotatable unit.

Sprinkler 350 comprises a pop-up mechanism which automatically raises the sprinkler when the water supply is turned on and lowers the sprinkler when the water supply is turned off.

Turbine driving chamber 360 contains a turbine 364 which rotates on two cone shaped pins 366 and 368 which sit in respective sockets 370 and 372 formed in the walls of turbine driving chamber 360.

A plurality of magnets 375 are attached to the blades of turbine 364 and magnetically couple turbine 364 to a reducing gear train located within sealed enclosure 362, via a magnetic coupling element 376, as will be described below.

Sealed enclosure 362 is supported by and rotates around a cone shaped pin 378 which is preferably formed as part of the bottom of sealed enclosure 362, and which fits in a socket 380. An annular shaped magnet 382 is located within sealed enclosure 362 for magnetic retaining interaction with another annular shaped magnet 384, which is fixedly mounted to a raisable casing 386 which does not rotate during sprinkler operation. The interaction of magnets 382 and 384 serves to fix one end of the gear train in the sealed enclosure 362 against rotation.

During operation, water from the water supply traverses liquid inlet 354, flows up the sides of casing 386, and enters turbine driving chamber 360 via one or more apertures 388, where it causes turbine 364 to rotate. This rotation of turbine 364 induces a rotation of magnet 376 causing the gear train inside sealed enclosure 362 and thus the sealed enclosure 362 to rotate relative to fixed magnet 382, as will now be described in connection with FIG. 17.

Figure 17:
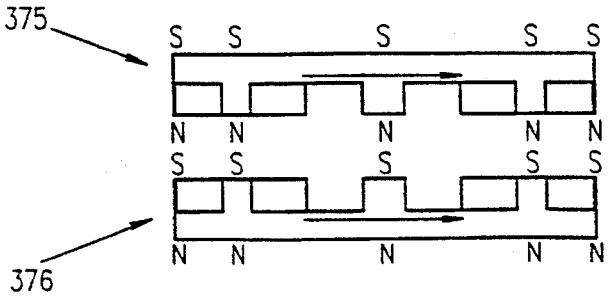
FIG. 17 is a simplified illustration of the arrangement of the permanent magnets in the sprinkler of FIG. 16.

As shown in FIG. 17, magnetic coupling element 375 is arranged so that the north poles thereof face the south poles of magnetic coupling element 376. Therefore, as turbine 364 rotates, the attractive force between magnetic coupling elements 375 and 376 induces a rotation in coupling element 376.

The magnetic structure of magnets 382 and 384 may be similar to that of magnetic coupling elements 375 and 376, other than in that magnets 382 and 384 are typically magnetically much stronger than magnetic coupling elements 375 and 376.

Reference is now made to FIGS. 18A–18C, 19A–19D and 20, which illustrate a direction change mechanism associated with the reducing gear of the sprinkler of FIG. 16 in accordance with a preferred embodiment of the present invention.

A plate 390 is fixedly attached to magnet 384. A direction changing assembly 392 is pivotably mounted onto plate 390, at a socket 393 for limited pivotal motion about a pin 394, which is integrally formed with plate 390. A protrusion 396, also integrally formed with plate 390 and typically formed as a pin, operatively engages a notch 398 formed in assembly 392, adjacent a permanent magnet 400, forming part thereof. The azimuthal width of notch 398 defines the limitations of pivotal rotation of assembly 392 about pin 394.

Four gears 402, 404, 406 and 408 are rotatably mounted on pins 394, 414, 416 and 418. Pin 394 extends though socket 393, while pins 414, 416 and 418 may be integrally formed with assembly 392. A gear 420, which forms part of the reducing gear of the sprinkler, drives either of gears 406 and 408 at a given time, depending on the pivotal orientation of assembly 392. The two alternative orientations are shown in FIGS. 18A and 18C respectively.

Figure 18A:
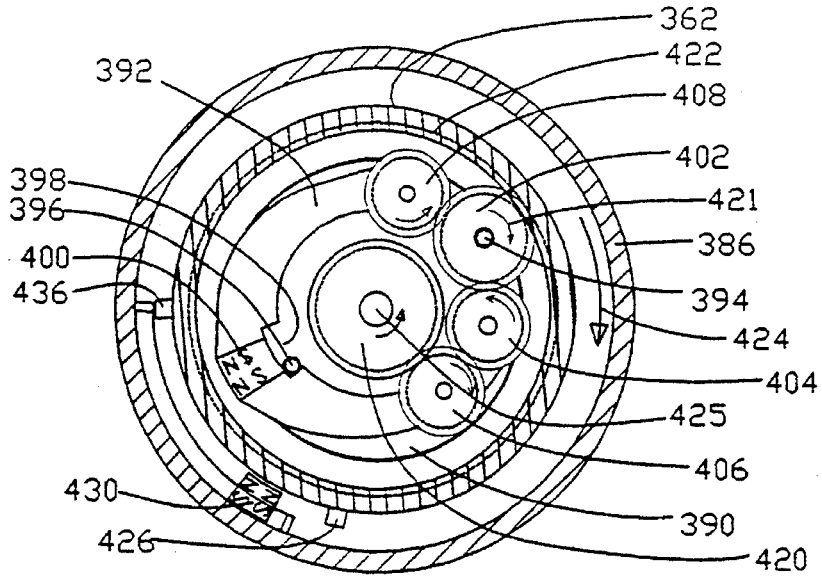
FIGS. 18A, 18B and 18C illustrate a direction change mechanism forming part of the sprinkler of FIG. 16 in accordance with a preferred embodiment of the present invention.

Gear 406 drives gear 404, which in turn drives gear 402 in a first direction, indicated by an arrow 421, as seen in FIG. 18A. Gear 408 drives gear 402 in a second direction, indicated by an arrow 423, as seen in FIG. 18C.

Gear 402 meshes with an interior threading 422 formed on the inside of sealed enclosure 362 (FIG. 16), producing rotation of the sealed enclosure 362.

In a first mode of operation, illustrated in FIG. 18A, gear 420 drives gear 406, which in turn drives gear 404, which drives 402, which, as noted above meshes with interior threading 422 on the inside of sealed enclosure 362 (FIG. 16) producing rotation of the sealed enclosure 362 in a first direction indicated by an arrow 424 about an axis 425. It is noted that assembly 392 remains stationary.

The rotation of enclosure 362 causes an azimuthal sprinkling zone defining protrusion 426, which is fixed or selectably located on the exterior of sealed enclosure 362 to define a changeable azimuthal sprinkling zone, to be brought into propinquity with a permanent magnet 430, azimuthally slidably mounted onto the inside of raisable casing 386. Engagement of protrusion 426 with magnet 430 forces magnet 430 to move azimuthally in the direction indicated by arrow 424.

Figure 18B:
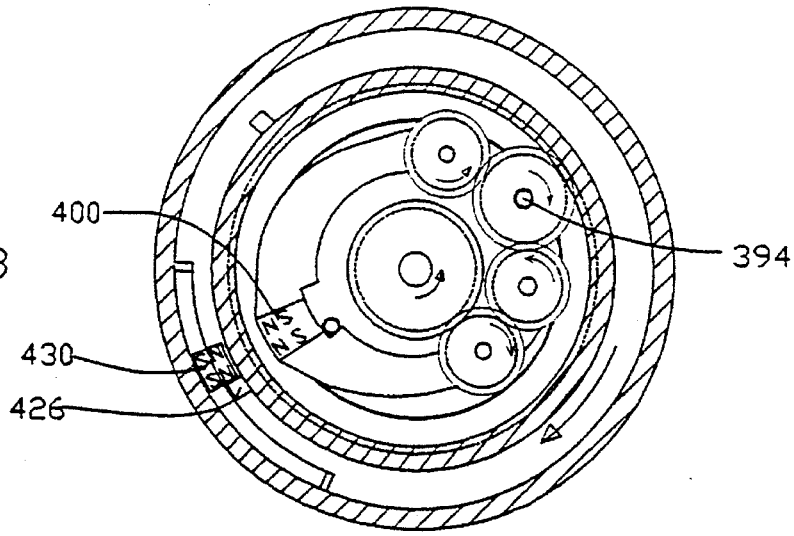
Figure 18C:
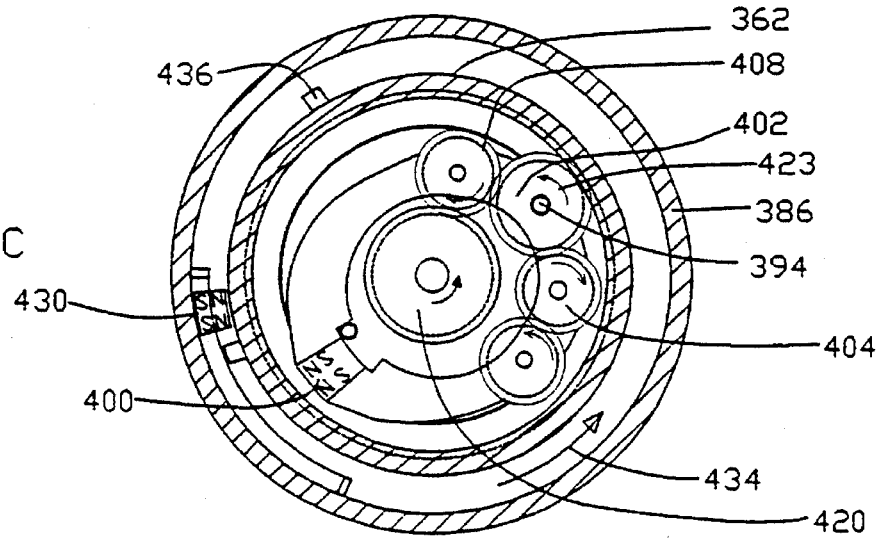
Figure 19A:
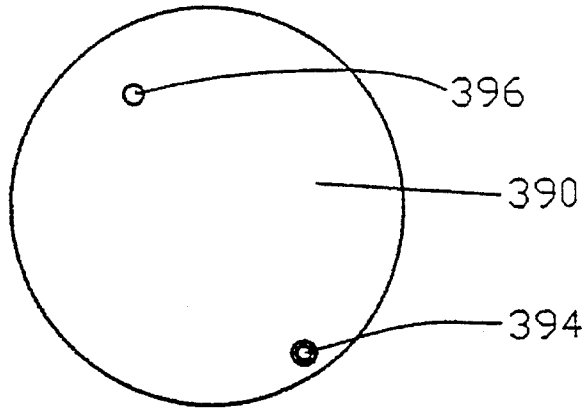
FIGS. 19A, 19B, 19C and 19D are planar illustrations of individual parts of the mechanism shown in FIGS. 18A–18C.
Figure 19B:
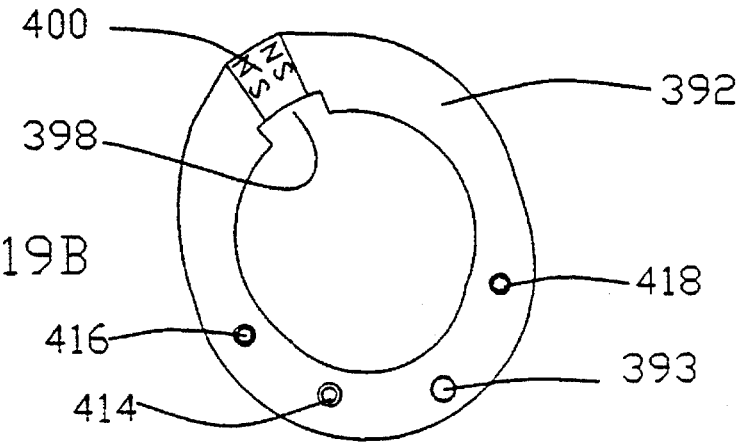
Figure 19C:
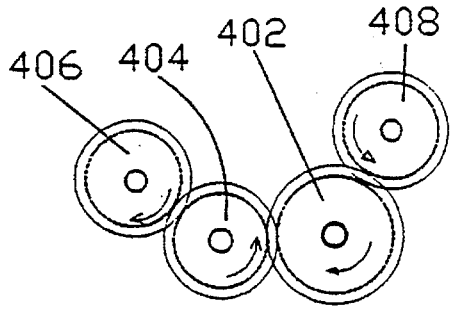
Figure 19D:
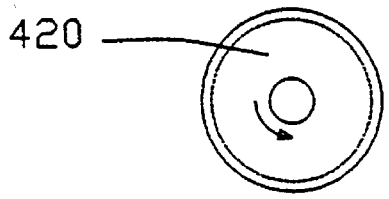
Figure 20:
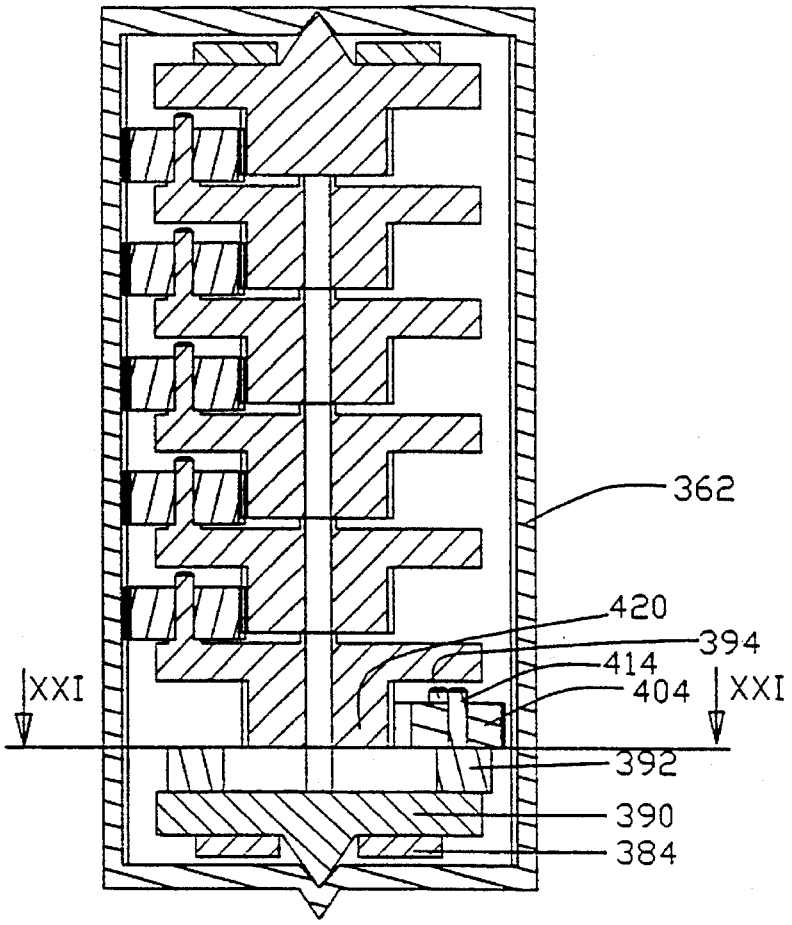
FIG. 20 is a sectional illustration of the reducing gear train located within sealed enclosure 362 including the mechanism of FIGS. 18A–19D.

Continued rotation of the sealed enclosure 362 and consequent azimuthal movement of magnet 430 in the direction indicated by arrow 424, brings magnet 430 into propinquity with permanent magnet 400, and to an equilibrium position illustrated in FIG. 18B. When magnet 430 passes the equilibrium position illustrated in FIG. 18B, the repulsive force between magnets 430 and 400 cause the assembly 392 to which magnet 400 is fixed, to pivot about pin 394 so as to reach the orientation shown in FIG. 18C, wherein gear 408 is engaged by gear 420.

When the assembly 392 is in the orientation shown in FIG. 18C, rotation of the sealed enclosure 362 occurs in a direction indicated by an arrow 434, opposite to that indicated by arrow 424. A similar sequence of motions occurs until a second azimuthal sprinkling zone defining protrusion 436, which is either fixed or selectably located on the exterior of sealed enclosure 362 to define a changeable azimuthal sprinkling zone, engages magnet 430.

Continued rotation of sealed enclosure 362 again brings the sprinkler past the equilibrium position, such that the repulsive force between magnets 430 and 400 cause the assembly 392 to which magnet 400 is fixed, to pivot about pin 394 so as to again reach the orientation shown in FIG. 18A, wherein gear 406 is engaged by gear 420. Continued reciprocal rotation of the sprinkler within an azimuthal zone defined by protrusions 426 and 436 may continue indefinitely.

The protrusions 426 and 436 may both be fixed, or alternatively one or both may be selectably positioned. The positioning of the protrusions may be achieved by disassembly of the sprinkler, as during filter cleaning, which provides access to the protrusions. Alternatively, linkages may be provided between the protrusions and external locations to permit an operator to adjust the positions of the protrusions without disassembly of the sprinkler.

Figure 21:
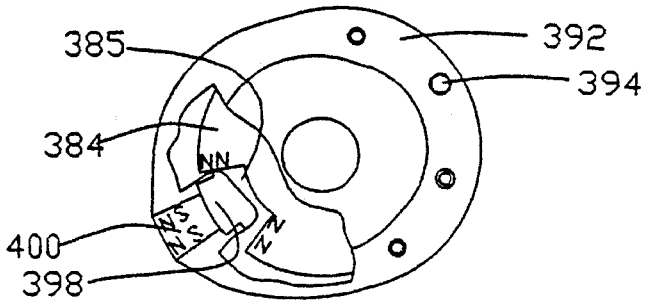
FIG. 21 is an illustration of part of the direction change mechanism shown in FIGS. 18A–19D.

Reference is now made to FIG. 21, which illustrates part of the direction changing mechanism shown in FIGS. 18A–19D in accordance with an alternative embodiment of the present invention. FIG. 21 is a partially broken away drawing taken generally along lines XXI—XXI in FIG. 20 and shows a preferred configuration of magnet 384. It is seen that magnet 384 is provided with a notch 385 and is magnetized to have the same polarity on both sides of the notch, as illustrated. In this configuration, magnets 384 and 400 are always in mutually attractive magnetic engagement. This attractive magnetic engagement tends to prevent assembly 392 from residing at an intermediate location other than the two extreme locations illustrated in FIGS. 18A and 18C.

Alternatively magnet 384 may be provided without notch 385. In such a case, it is desirable that magnet 384 should not interfere with the magnetic interaction between magnets 400 and 430 described hereinabove with reference to FIGS. 18A–18C to an extent which would impair the operation of the sprinkler as described.

Figure 22A:
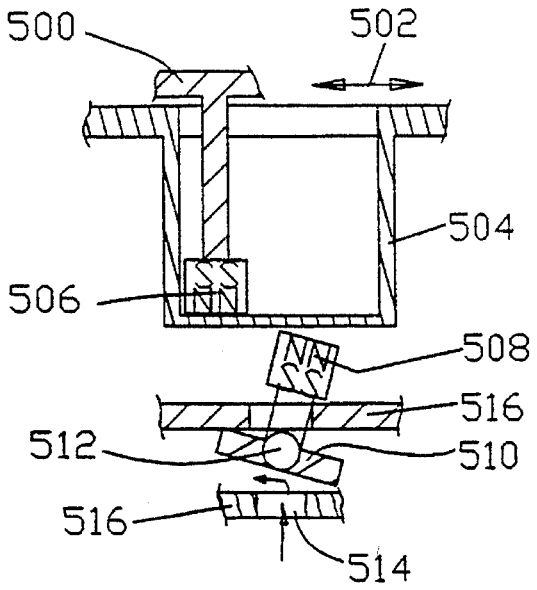
FIGS. 22A, 22B and 22C are simplified illustrations of a water flow direction changing mechanism constructed and operative in accordance with a preferred embodiment of the present invention.
Figure 22B:
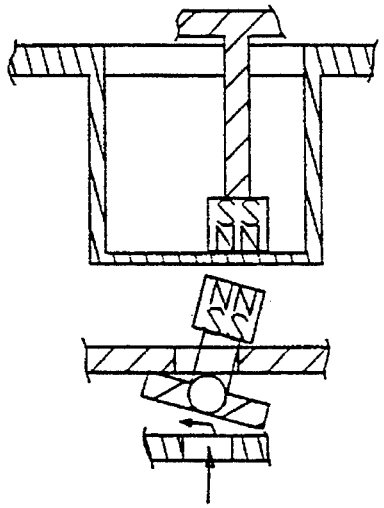
Figure 22C:
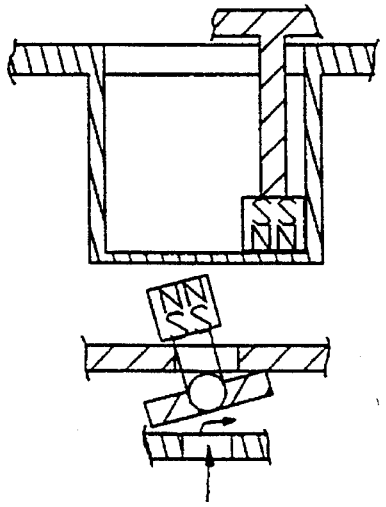

Reference is now made to FIGS. 22A–22C, which illustrate a magnet operated mechanism for varying the direction of the flow of water in a sprinkler, such as a turbine-driven sprinkler. Reference is made in this context to applicant/assignee's U.S. Pat. No. 5,031,833, the disclosure of which is hereby incorporated by reference, and particularly to FIGS. 5A and 5B thereof.

An element 500, which corresponds to element 60 in FIG. 5A of U.S. Pat. No. 5,031,833, is displaceable in a plane indicated by arrows 502 within an enclosure 504 and is formed at a bottom portion thereof with a magnet 506.

A second magnet 508 is disposed outside of and below enclosure 504, is fixed to a water directing vane 510 and is arranged for pivotal motion about a pivot axis 512, which corresponds to axis 92 in FIGS. 5A and 5B of U.S. Pat. No. 5,031,833. Vane 510 is operative to direct water entering via an aperture 514 in an element 516, which corresponds to aperture 44 in FIGS. 5A and 5B.

As element 500 is displaced along arrows 502 from side to side of enclosure 504, magnet 506 interacts by repulsion with magnet 508 causing it to undergo overcenter rotation about pivot axis 512, thereby changing the orientation of vane 510 and of the water flow, as illustrated in FIGS. 22A–22C.

Figure 23A:
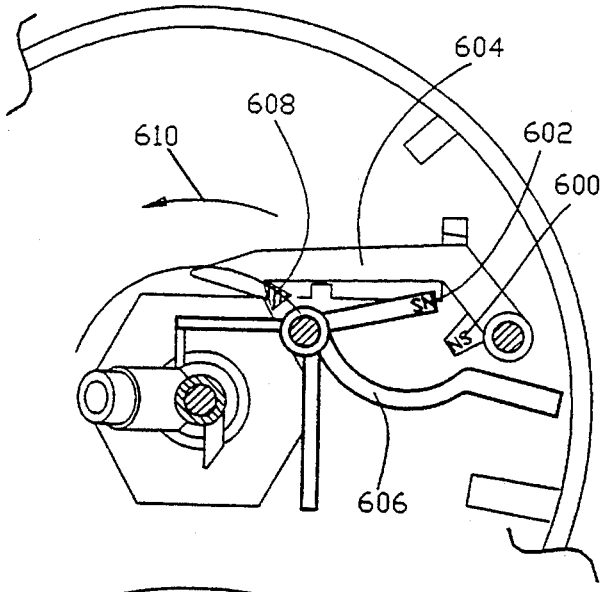
FIGS. 23A, 23B and 23C are simplified illustrations of a water outlet rotation direction changing mechanism constructed and operative in accordance with a preferred embodiment of the present invention.
Figure 23B:
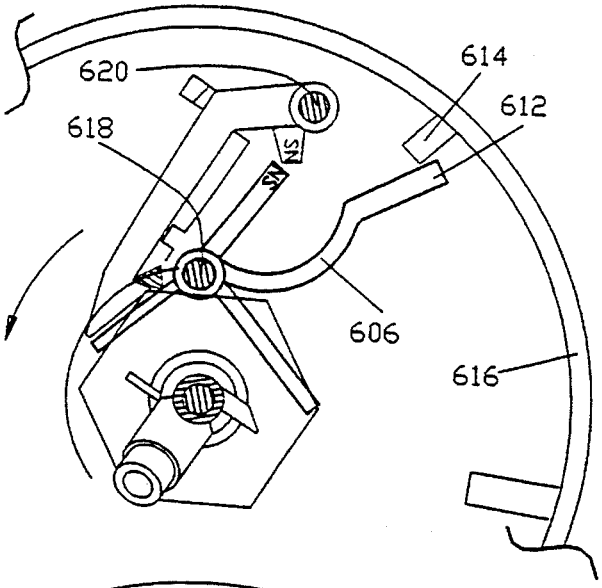
Figure 23C:
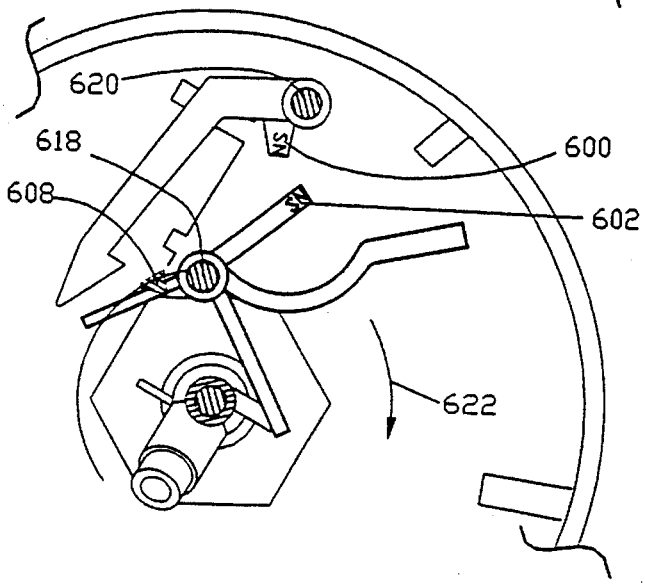

Reference is now made to FIGS. 23A–23C, which illustrate a magnet operated mechanism for varying the direction of the water outlet in a sprinkler. Reference is made in this context to applicant/assignee's U.S. Pat. No. 4,540,125, the disclosure of which is hereby incorporated by reference, and particularly to FIGS. 9C and 9D as well as to FIGS. 1 and 11A thereof.

First and second magnets 600 and 602 are mounted as shown respectively on an amplitude limiting element 604, corresponding to amplitude limiting element 80 in FIG. 11A, and on a sponding limiting function control finger element 606, corresponding to limiting function control finger element 84 in FIG. 11A of U.S. Pat. No. 4,540,125. The two magnets operate to provide over-center positioning of the respective elements 604 and 606 much in the same way as spring 85 provides over-center positioning of elements 80 and 84 in the embodiment of FIGS. 9C and 9D of U.S. Pat. No. 4,540,125.

It is seen that in FIG. 23A, elements 604 and 606 are maintained in a first relative orientation by mutual repulsion between magnets 600 and 602 with the result that the amplitude of motion of the hammer, of which only the engagement portion 608, corresponding to engagement portion 88 in FIG. 11A, is shown, is restricted by engagement of the engagement portion 608 with element 604, producing rotation of the nozzle outlet in a direction indicated by an arrow 610.

Upon engagement of an end portion 612 of element 606 with a protrusion 614 defining an azimuthal area to be watered, magnet 602 is rotated about an axis 618 and thus repositioned with respect to magnet 600. The repulsion between magnets 600 and 602, causes magnet 600 and thus element 604 to be rotated about an axis 620, thus repositioning element 604 such that it does not engage engagement portion 608 and thus does not limit the amplitude of motion of the hammer. This enables the water outlet to rotate in a direction indicated by an arrow 622.

It is to be appreciated that the magnetic coupling elements described hereinabove in the various embodiments of the invention may be formed by injection molding of plastic containing conventional magnetic materials, so as to provide desired relative polarities of various regions of the coupling elements. The magnetic coupling elements may also include regions which are not magnetic.

It is also appreciated that the intermittent magnetic coupling may be employed to replace a reducing gear train in a sprinkler.

It will be appreciated by those skilled in the art that the present invention is not limited to what has been particularly shown and described hereinabove. While several embodiments for implementing the invention have been described, many other embodiments for implementing the invention will occur to those of ordinary skill upon reading this disclosure. Therefore, the scope of the present invention is defined only by the following claims.

We claim:

1. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, said magnetic coupling including at least one driving magnet and at least one driven magnet and wherein rotation of said at least one driving magnet produces intermittent rotation of said at least one driven magnet.

2. The sprinkler according to claim 1 and wherein said at least one driven magnetic is driven by said at least one driving magnet but not in physical contact therewith.

3. A sprinkler according to claim 2 and wherein said at least one driving magnet and said at least one driven magnet are arranged to exert an attractive force on each other.

4. A sprinkler according to claim 1 and wherein said at least one driving magnet is mounted on a turbine driven for rotation by said pressurized flow of liquid.

5. A sprinkler according to claim 4 and wherein said at least one driving magnet and said at least one driven magnet are restricted to rotation in parallel mutually spaced planes and wherein spacing between the planes of rotation of said at least one driving magnet and said at least one driven magnet is decreased to a spacing at which a repelling magnetic force interaction between the at least one driving magnet and the at least one driven magnet can take place in response to at least a predetermined rate of flow of said liquid.

6. A sprinkler according to claim 1 and wherein said at least one driving magnet is mounted for rotation by said pressurized flow of liquid.

7. A sprinkler according to claim 6 and wherein said at least one driving magnet is tethered to a fixed location and wherein spacing between the at least one driving magnet and said at least one driven magnet is decreased to a spacing at which a repelling magnetic force interaction between the at least one driving magnet and the at least one driven magnet can take place in response to at least a predetermined rate of flow of said liquid.

8. A sprinkler according to claim 1 and wherein said at least one driving magnet is mounted for rotation in a plane at a radial location determined at least in part by said pressurized flow of liquid.

9. A sprinkler according to claim 8 and wherein said at least one driving magnet is tethered to a fixed location and wherein radial spacing between the at least one driving magnet and said at least one driven magnet is decreased to a spacing at which a repelling magnetic force interaction between the at least one driving magnet and the at least one driven magnet can take place in response to at least a predetermined rate of flow of said liquid.

10. A sprinkler according to claim 8 and wherein said at least one driving magnet is radially slidably mounted in a plane whereby the radial orientation of its magnetic poles is maintained and wherein radial spacing between the at least one driving magnet and said at least one driven magnet is decreased to a spacing at which a repelling magnetic force interaction between the at least one driving magnet and the at least one driven magnet can take place in response to at least a predetermined rate of flow of said liquid.

11. A sprinkler according to claim 1 and also comprising azimuthal sprinkling zone defining apparatus including magnets.

12. A sprinkler according to claim 11 and wherein said azimuthal sprinkling zone defining apparatus comprises at least first and second magnets interacting in a repulsion mode.

13. A sprinkler according to claim 11 and wherein said magnets define an over-center mechanism.

14. A sprinkler according to claim 11 and wherein said sprinkler is a gear sprinkler and said magnets define an over-center mechanism which changes the direction of rotation of the liquid outlet by varying the engagement arrangement of gears.

15. A sprinkler according to claim 11 and wherein said sprinkler is an impact sprinkler and said magnets define an over-center mechanism which changes the direction of rotation of the liquid outlet by changing the mode of operation of an impact assembly forming part thereof.

16. A sprinkler according to claim 11 and wherein said magnets form part of a water flow direction change mechanism.

17. A sprinkler according to claim 1, wherein said magnetic coupling comprises a coupled pair of magnetic coupling elements.

18. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, wherein the magnetic coupling comprises at least one rotating driving magnet and wherein said apparatus for rotating is not engaged until said at least one rotating driving magnet is rotating at a predetermined minimum rate of rotation.

19. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, and wherein said magnetic coupling comprises first and second pairs of magnetic coupling elements and further comprising:

a gear train located in a watertight sealed section of said sprinkler and comprising a plurality of gears, including:

a first gear, mechanically driven by said first pair of magnetic coupling elements; and a last gear, mechanically driving said liquid outlet via said second pair of magnetic coupling elements.

20. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, wherein the magnetic coupling comprises at least one driving magnet and at least one driven magnet driven by said at least one driving magnet but not in physical contact therewith, and wherein said said at least one driving magnet and said at least one driven magnet are arranged to exert a repelling force on each other.

21. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, wherein the magnetic coupling comprises at least one driving magnet and at least one driven magnet driven by said at least one driving magnet but not in physical contact therewith, and wherein rotation of said at least one driving magnet exerts a force on said at least one driven magnet only during a portion of the rotation thereof.

22. A sprinkler comprising:

a liquid inlet;

a liquid outlet rotatable with respect to said liquid inlet; and apparatus, driven by a pressurized flow of liquid entering said liquid inlet, for rotating said liquid outlet, said apparatus including a magnetic coupling for transmitting motion, and wherein the magnetic coupling comprises:

a rotating driving magnet; and a rotatable driven magnet coupled to said liquid outlet, whereby said driving magnet and said driven magnet are close enough to interact only as said driving magnet rotates past said driven magnet, wherein the inertia of said driven magnet and said liquid outlet are such that as said rotating driving magnet rotates past said driven magnet in propinquity thereto, the force exerted by said rotating magnet on said driven magnet is sufficient to move said driven magnet a short distance.

* * * * *